US009207614B2

(12) United States Patent
Kakutani et al.

(10) Patent No.: US 9,207,614 B2
(45) Date of Patent: Dec. 8, 2015

(54) IMAGE FORMING APPARATUS EQUIPPED WITH DEVELOPER REPLENISHMENT MECHANISM

(71) Applicant: CANON KABUSHIKI KAISHA, Tokyo (JP)

(72) Inventors: Toshifumi Kakutani, Abiko (JP); Kazumi Sato, Kashiwa (JP); Yousuke Hata, Ichikawa (JP); Shinya Suzuki, Toride (JP); Takayuki Iikura, Kashiwa (JP); Kazunori Miyake, Abiko (JP)

(73) Assignee: CANON KUBUSHIKI KAISHA (JP)

( * ) Notice: Subject to any disclaimer, the term of this patent is extended or adjusted under 35 U.S.C. 154(b) by 0 days.

(21) Appl. No.: 14/477,240

(22) Filed: Sep. 4, 2014

(65) Prior Publication Data

US 2015/0071657 A1 Mar. 12, 2015

(30) Foreign Application Priority Data

Sep. 6, 2013 (JP) ..... 2013-184640

(51) Int. Cl.

*G03G 15/00* (2006.01)
*G03G 21/16* (2006.01)
*G03G 15/08* (2006.01)

(52) U.S. Cl.

CPC ..... *G03G 15/556* (2013.01); *G03G 21/1676* (2013.01); *G03G 15/0865* (2013.01)

(58) Field of Classification Search

CPC ..... G03G 15/556; G03G 21/1676; G03G 2215/0663; G03G 2215/0668

See application file for complete search history.

(56) References Cited

U.S. PATENT DOCUMENTS

| | | | | |
|---|---|---|---|---|
| 7,620,334 | B2 * | 11/2009 | Shimizu | 399/30 |
| 2007/0003296 | A1 * | 1/2007 | Miyata | 399/27 |
| 2009/0297172 | A1 * | 12/2009 | Kaji | 399/13 |
| 2012/0014713 | A1 | 1/2012 | Murakami et al. | |

* cited by examiner

*Primary Examiner* — Sandra Brase

(74) *Attorney, Agent, or Firm* — Rossi, Kimms & McDowell LLP

(57) ABSTRACT

An image forming apparatus capable of reducing an image defect even when an container is rotated for checking. A development unit forms an image by developing an electrostatic latent image on a photosensitive member. A drive unit rotates the container mounted to a mounting portion for replenishing the toner to the development unit. An output unit outputs a specified signal when detecting a predetermined portion of the container. A determination unit determines whether the container is mounted to the mounting portion according to the specified signal. A decision unit decides a toner replenishing amount based on image data. A controller controls the drive unit to execute a detecting operation that rotates the container when the determination unit does not determine that the container is mounted. A correction unit corrects the toner replenishing amount based on the output of the output unit when the detecting operation is executed.

10 Claims, 15 Drawing Sheets

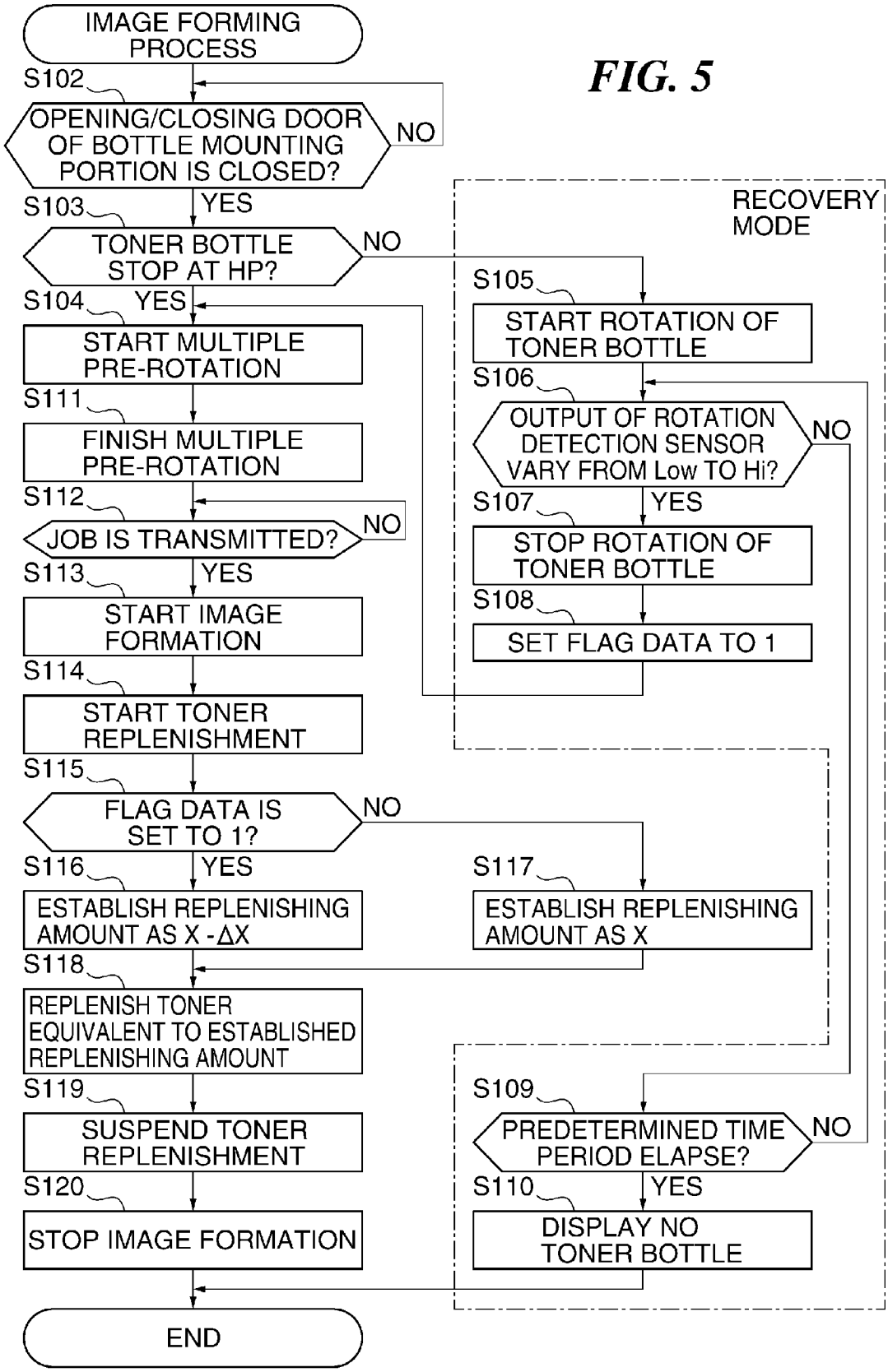
FIG. 5
IMAGE FORMING PROCESS
S102
OPENING/CLOSING DOOR OF BOTTLE MOUNTING PORTION IS CLOSED?
NO
YES
S103
TONER BOTTLE STOP AT HP?
NO
YES
S104
START MULTIPLE PRE-ROTATION
S111
FINISH MULTIPLE PRE-ROTATION
S112
JOB IS TRANSMITTED?
NO
YES
S113
START IMAGE FORMATION
S114
START TONER REPLENISHMENT
S115
FLAG DATA IS SET TO 1?
NO
YES
S116
ESTABLISH REPLENISHING AMOUNT AS X -ΔX
S117
ESTABLISH REPLENISHING AMOUNT AS X
S118
REPLENISH TONER EQUIVALENT TO ESTABLISHED REPLENISHING AMOUNT
S119
SUSPEND TONER REPLENISHMENT
S120
STOP IMAGE FORMATION
END
RECOVERY MODE
S105
START ROTATION OF TONER BOTTLE
S106
OUTPUT OF ROTATION DETECTION SENSOR VARY FROM Low TO Hi?
NO
YES
S107
STOP ROTATION OF TONER BOTTLE
S108
SET FLAG DATA TO 1
S109
PREDETERMINED TIME PERIOD ELAPSE?
NO
YES
S110
DISPLAY NO TONER BOTTLE

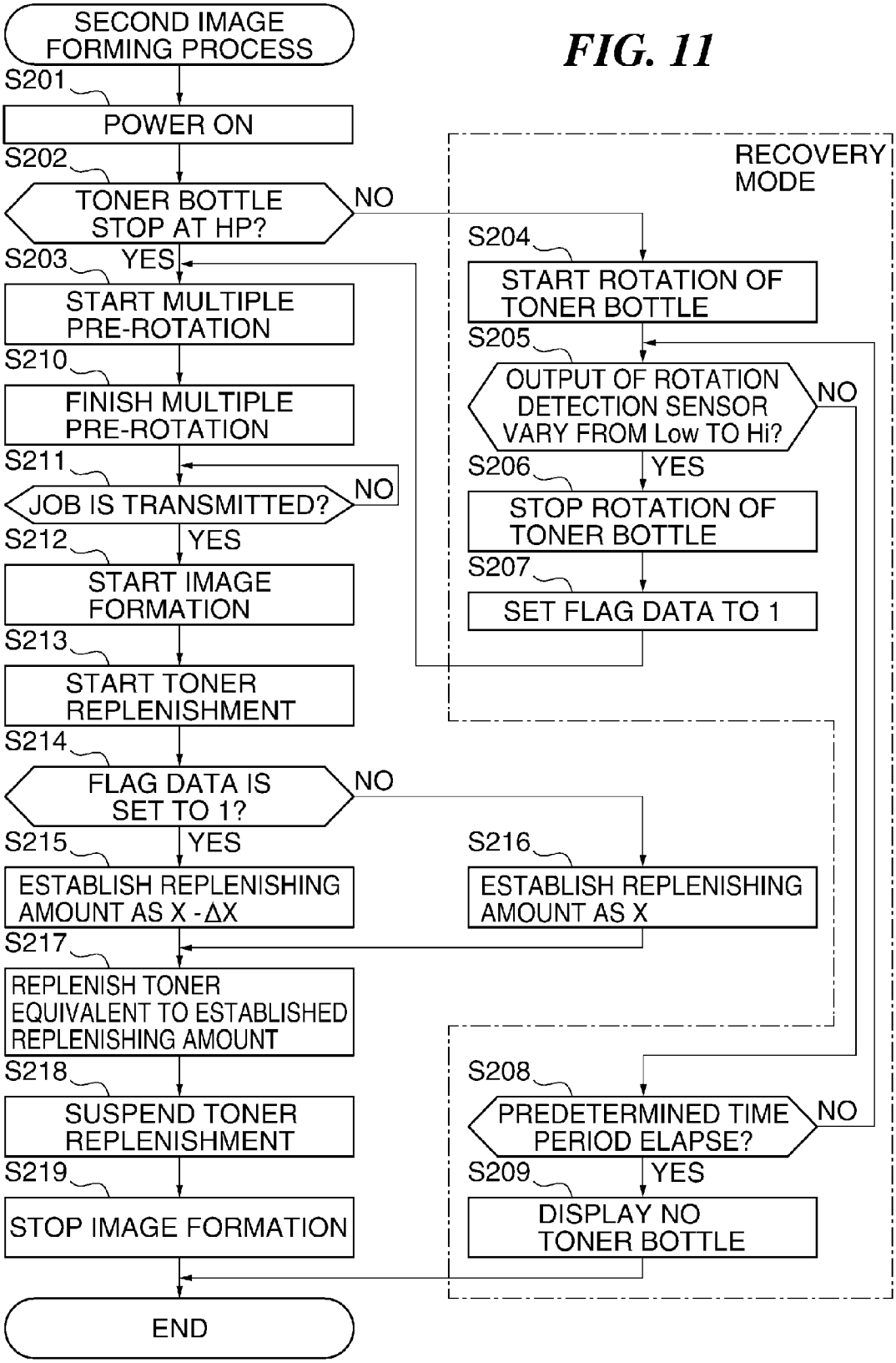
FIG. 11
SECOND IMAGE FORMING PROCESS
S201
POWER ON
S202
TONER BOTTLE STOP AT HP?
NO
S203
YES
START MULTIPLE PRE-ROTATION
S210
FINISH MULTIPLE PRE-ROTATION
S211
JOB IS TRANSMITTED?
NO
S212
YES
START IMAGE FORMATION
S213
START TONER REPLENISHMENT
S214
FLAG DATA IS SET TO 1?
NO
S215
YES
ESTABLISH REPLENISHING AMOUNT AS X - ΔX
S216
ESTABLISH REPLENISHING AMOUNT AS X
S217
REPLENISH TONER EQUIVALENT TO ESTABLISHED REPLENISHING AMOUNT
S218
SUSPEND TONER REPLENISHMENT
S219
STOP IMAGE FORMATION
END
RECOVERY MODE
S204
START ROTATION OF TONER BOTTLE
S205
OUTPUT OF ROTATION DETECTION SENSOR VARY FROM Low TO Hi?
NO
S206
YES
STOP ROTATION OF TONER BOTTLE
S207
SET FLAG DATA TO 1
S208
PREDETERMINED TIME PERIOD ELAPSE?
NO
S209
YES
DISPLAY NO TONER BOTTLE

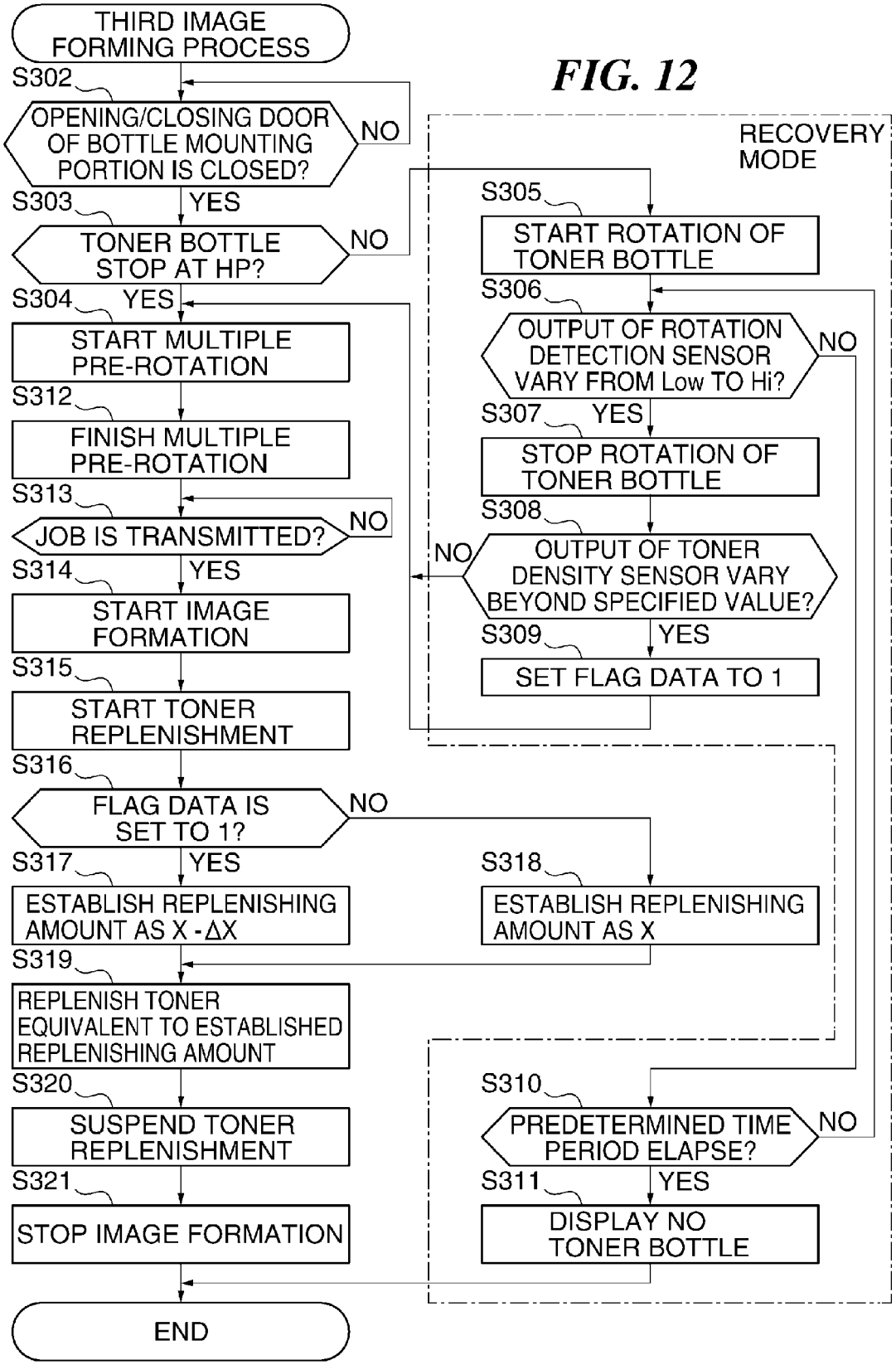
FIG. 12
THIRD IMAGE FORMING PROCESS
S302
OPENING/CLOSING DOOR OF BOTTLE MOUNTING PORTION IS CLOSED?
NO
S303
YES
TONER BOTTLE STOP AT HP?
NO
S304
YES
START MULTIPLE PRE-ROTATION
S312
FINISH MULTIPLE PRE-ROTATION
S313
JOB IS TRANSMITTED?
NO
S314
YES
START IMAGE FORMATION
S315
START TONER REPLENISHMENT
S316
FLAG DATA IS SET TO 1?
NO
S317
YES
ESTABLISH REPLENISHING AMOUNT AS X -ΔX
S318
ESTABLISH REPLENISHING AMOUNT AS X
S319
REPLENISH TONER EQUIVALENT TO ESTABLISHED REPLENISHING AMOUNT
S320
SUSPEND TONER REPLENISHMENT
S321
STOP IMAGE FORMATION
END
RECOVERY MODE
S305
START ROTATION OF TONER BOTTLE
S306
OUTPUT OF ROTATION DETECTION SENSOR VARY FROM Low TO Hi?
NO
S307
YES
STOP ROTATION OF TONER BOTTLE
S308
OUTPUT OF TONER DENSITY SENSOR VARY BEYOND SPECIFIED VALUE?
NO
S309
YES
SET FLAG DATA TO 1
S310
PREDETERMINED TIME PERIOD ELAPSE?
NO
S311
YES
DISPLAY NO TONER BOTTLE

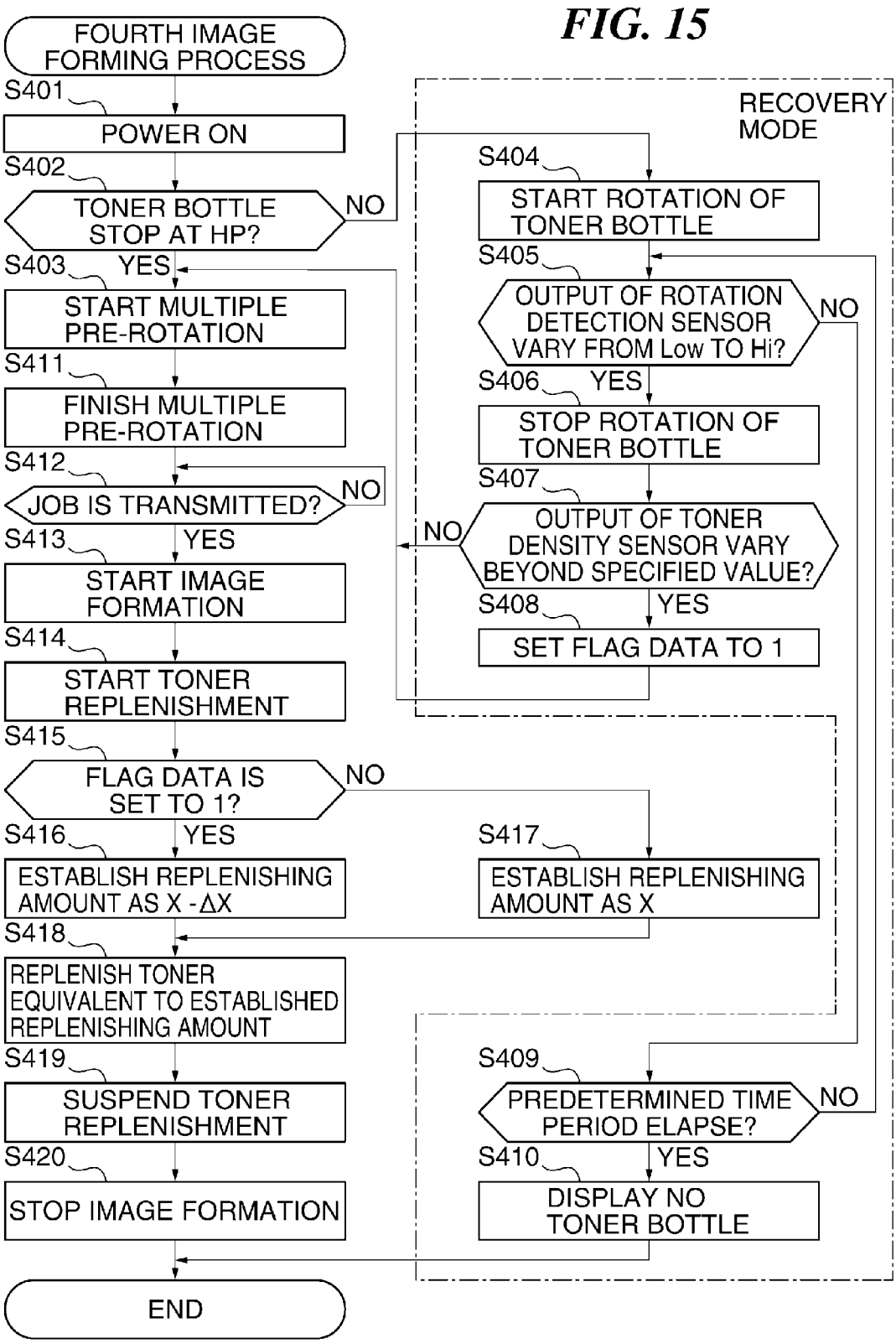
FIG. 15
FOURTH IMAGE FORMING PROCESS
S401
POWER ON
S402
TONER BOTTLE STOP AT HP?
NO
YES
S403
START MULTIPLE PRE-ROTATION
S411
FINISH MULTIPLE PRE-ROTATION
S412
JOB IS TRANSMITTED?
NO
YES
S413
START IMAGE FORMATION
S414
START TONER REPLENISHMENT
S415
FLAG DATA IS SET TO 1?
NO
YES
S416
ESTABLISH REPLENISHING AMOUNT AS X -ΔX
S417
ESTABLISH REPLENISHING AMOUNT AS X
S418
REPLENISH TONER EQUIVALENT TO ESTABLISHED REPLENISHING AMOUNT
S419
SUSPEND TONER REPLENISHMENT
S420
STOP IMAGE FORMATION
END
RECOVERY MODE
S404
START ROTATION OF TONER BOTTLE
S405
OUTPUT OF ROTATION DETECTION SENSOR VARY FROM Low TO Hi?
NO
YES
S406
STOP ROTATION OF TONER BOTTLE
S407
OUTPUT OF TONER DENSITY SENSOR VARY BEYOND SPECIFIED VALUE?
NO
YES
S408
SET FLAG DATA TO 1
S409
PREDETERMINED TIME PERIOD ELAPSE?
NO
YES
S410
DISPLAY NO TONER BOTTLE

IMAGE FORMING APPARATUS EQUIPPED WITH DEVELOPER REPLENISHMENT MECHANISM

BACKGROUND OF THE INVENTION

1. Field of the Invention

The present invention relates to an image forming apparatus equipped with a developer replenishment mechanism that replenishes developer to a development device that develops an electrostatic latent image formed on an image bearing member.

2. Description of the Related Art

An image forming apparatus of an electrophotographic system forms a toner image by developing an electrostatic latent image formed on a photosensitive member using developer (referred to as toner, hereafter) in a development device. Since the amount of toner that can be accumulated in the development device is limited, the toner is replenished to the development device from a container that is detachable to the main body of the image forming apparatus.

For example, there is proposed a container that is provided with a rotation portion that is rotated, a pump portion for changing internal pressure of a chamber to discharge toner from the chamber that accommodates the toner, and a converter that converts a rotating motion of the rotation portion into a reciprocating motion of the pump portion (see US 20120014713A1). This container discharges the toner in a chamber by making the pump portion expand and contract according to the rotation of the container. That is, the air that is sucked from a discharging port as the pump portion expands loosens the toner in the chamber, and then, the chamber becomes in a positive pressure state and the air in the chamber forces out the toner, which covers the discharging port, from the discharging port as the pump portion contracts.

Moreover, there is a known conventional configuration in which a detection device in an image forming apparatus detects a detected portion of a container in order to determine whether the container is mounted to the image forming apparatus.

The above-mentioned prior arts suggest a configuration in which the detection device in the image forming apparatus detects the detected portion that rotates with the above-mentioned container in order to check whether the container is mounted to the image forming apparatus and to detect the number of replenishments of toner from the container.

However, when the container rotates just after mounting it to the image forming apparatus so that the detection device is able to detect the detected portion, the toner is discharged from the container whenever the container is mounted to the image forming apparatus.

Accordingly, when the toner is replenished to the development device from the container so as to supplement consumed toner during an image formation after repeating mounting and dismounting of the container, the amount of toner in the development device increases excessively, which causes an image defect.

SUMMARY OF THE INVENTION

The present invention provides an image forming apparatus that is capable of reducing an image defect even when the container is rotated in order to check whether the container is mounted to the image forming apparatus.

Accordingly, a first aspect of the present invention provides an image forming apparatus comprising a photosensitive member, an exposure unit configured to expose the photosensitive member to form an electrostatic latent image on the photosensitive member, a development unit configured to form an image corresponding to the image data by developing the electrostatic latent image formed on the photosensitive member, a mounting portion configured to which a container is mountable, the container that contains toner, a drive unit configured to rotate the container mounted to the mounting portion for replenishing the toner in the container to the development unit, an output unit configured to output a predetermined signal when a predetermined portion of the container mounted to the mounting portion is detected, the predetermined portion being arranged in the rotation direction of the container that is rotated by the drive unit, a determination unit configured to determine whether the container is mounted to the mounting portion according to whether the predetermined signal is outputted from the output unit, a decision unit configured to decide a toner replenishing amount that should be replenished to the development unit, a controller configured to control the drive unit so as to execute a detecting operation that rotates the container in a case where the determination unit does not determine that the container is mounted to the mounting portion, and a correction unit configured to correct the toner replenishing amount based on the predetermined signal output by the output unit during the detecting operation is executed.

According to the present invention, an image defect is reduced even when the container is rotated in order to check whether the container is mounted to the image forming apparatus.

Further features of the present invention will become apparent from the following description of exemplary embodiments with reference to the attached drawings.

BRIEF DESCRIPTION OF THE DRAWINGS

FIG. 5 is a flowchart showing an image forming process according to the first embodiment of the present invention.

FIG. 11 is a flowchart showing an image forming process according to a second embodiment of the present invention.

FIG. 12 is a flowchart showing an image forming process according to a third embodiment of the present invention.

FIG. 15 is a flowchart showing an image forming process according to a fourth embodiment of the present invention.

DESCRIPTION OF THE EMBODIMENTS

Hereafter, embodiments according to the present invention will be described in detail with reference to the drawings.

Figure 1:
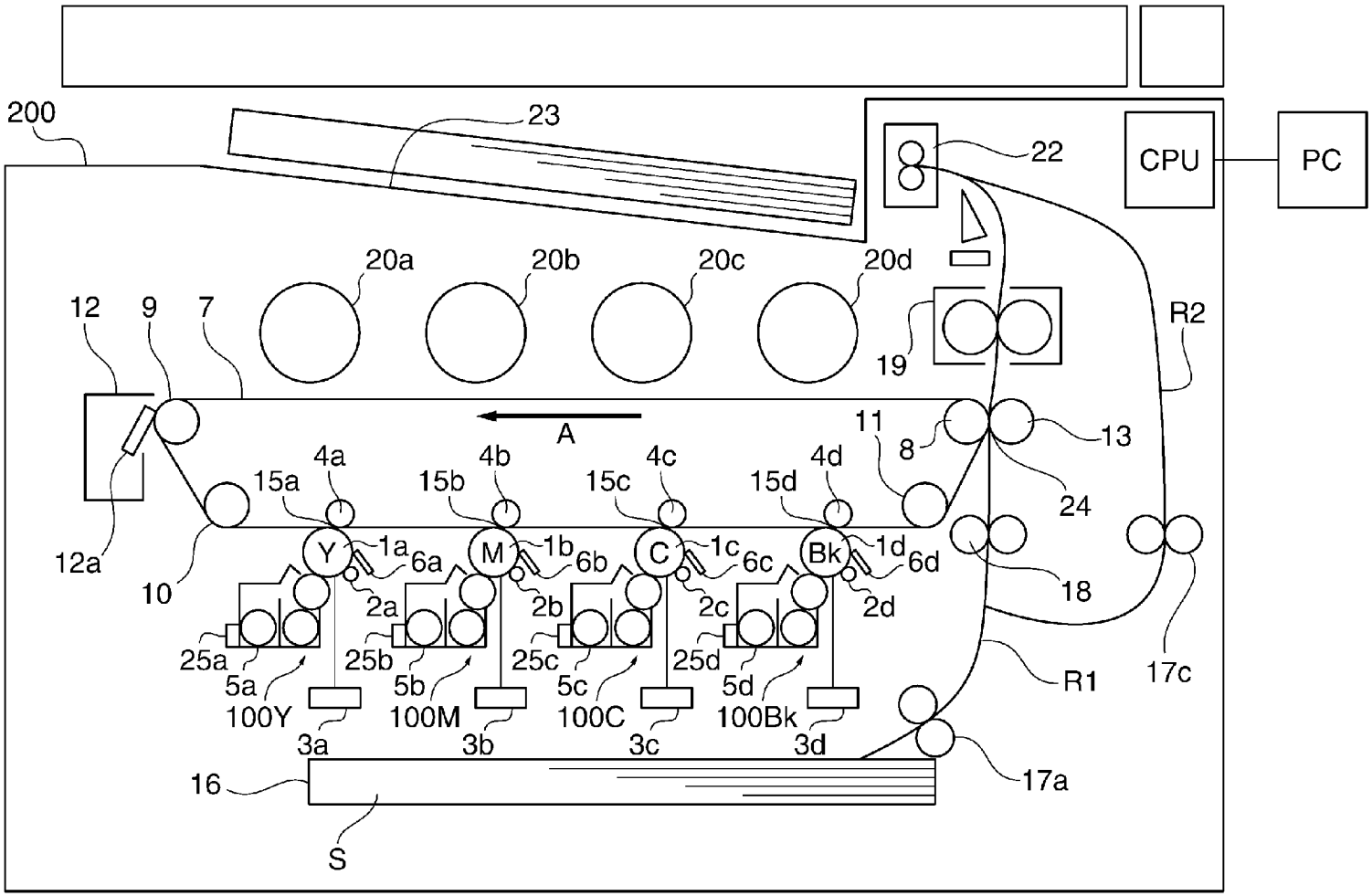
FIG. 1 is a sectional view schematically showing a configuration of an image forming apparatus according to an embodiment of the present invention.

FIG. 1 is a sectional view schematically showing a configuration of an image forming apparatus according to a first embodiment.

As shown in FIG. 1, the image forming apparatus 200 is a color image forming apparatus that employs an electrophotographic system, and is an image forming apparatus of an intermediate transfer tandem system in which image forming units 100Y, 100M, 100C, and 100Bk corresponding to four colors are arranged side by side in an approximately horizontal direction, for example. The intermediate transfer tandem system becomes mainstream in recent years from a point of high manufacturability and a point of flexibility in conveyance of various media.

The image forming units 100Y, 100M, 100C, and 100Bk are provided with photosensitive drums 1*a*, 1*b*, 1*c*, and 1*d*, charging devices 2*a*, 2*b*, 2*c*, and 2*d*, exposure devices 3*a*, 3*b*, 3*c*, and 3*d*, development devices 5*a*, 5*b*, 5*c*, and 5*d*, and primary transfer rollers 4*a*, 4*b*, 4*c*, and 4*d*, respectively. The development devices 5*a*, 5*b*, 5*c*, and 5*d* have toner density sensors 25*a*, 25*b*, 25*c*, and 25*d*, respectively, as density detection units that detect toner densities in the respective development devices. The toner density sensors 25*a* through 25*d* are magnetic permeability sensors that output signals in response to magnetic permeabilities that vary with the toner amounts in the development devices 5*a* through 5*d*, for example.

The image forming unit 100Y, 100M, 100C, and 100Bk are provided with drum cleaners 6*a*, 6*b*, 6*c*, and 6*d*, respectively. An intermediate transfer belt 7 is arranged in the image forming apparatus 200. The intermediate transfer belt 7 is an endless belt, and rotates in a direction of an arrow A in FIG. 1. The intermediate transfer belt 7 is looped over a driving roller 8 (a secondary transfer internal roller 8) that drives the intermediate transfer belt 7 concerned, a tension roller 9, a roller 10, and a roller 11 so as to be rotatable. Toner bottles 20*a*, 20*b*, 20*c*, and 20*d* as containers that replenish toner as developer to the development devices 5*a*, 5*b*, 5*c*, and 5*d* of the image forming units, respectively, are arranged above the intermediate transfer belt 7.

A sheet cassette 16 is arranged under the image forming units 100Y through 100Bk. The sheet cassette 16 stores a sheet S as a recording medium. A conveyance path R1 is formed from the sheet cassette 16 to an ejecting roller pair 22 through a secondary transfer area 24 and a fixing device 19. A feed roller pair 17*a* and a registration roller pair 18 that employ a frictional separation method are arranged along the conveyance path R1. The fixing device 19 is provided with a heater (not shown) used as a heat source. Moreover, an inversion path R2 is formed from the ejecting roller pair 22 to the upstream side of the registration roller pair 17*c* in the conveyance path R2 so as to be parallel with the conveyance path R1.

Next, an operation of each unit of the image forming apparatus 200 when the image forming apparatus 200 forms an image on a sheet S will be described. After the photosensitive drums 1*a* through 1*d* of the image forming units 100Y through 100Bk start rotation, the charging devices 2*a* through 2*d* uniformly charge the surfaces of the photosensitive drums 1*a* through 1*d*. Next, the exposure devices 3*a* through 3*d* irradiate the photosensitive drums 1*a* through 1*d* with laser beams modulated based on image signals in order to form electrostatic latent images on the photosensitive drums 1*a* through 1*d*, and the electrostatic latent images are formed on the photosensitive drums 1*a* through 1*d*. The development devices 5*a* through 5*d* develop the electrostatic latent images formed on the photosensitive drums 1*a* through 1*d* using toner. The electrostatic latent images on the photosensitive drums 1*a* through 1*d* appear as toner images. When primary transfer biases are given to the toner images formed on the photosensitive drums 1*a* through 1*d* in primary transfer areas 15*a* through 15*d*, the toner images are transferred to the intermediate transfer belt 7. When the toner images formed by the image forming units 100Y through 100Bk are transferred to the intermediate transfer belt 7 in piles, a full color image is borne on the intermediate transfer belt 7. The primary transfer areas 15*a*, 15*b*, 15*c*, and 15*d* are formed between the photosensitive drums 1*a*, 1*b*, 1*c*, and 1*d* and the primary transfer rollers 4*a*, 4*b*, 4*c*, and 4*d* of the respective image forming units.

The toner that is remained on the photosensitive drums 1*a* through 1*d* without being transferred to the intermediate transfer belt 7 is removed from the photosensitive drums 1*a* through 1*d* by the drum cleaners 6*a* through 6*d*. Moreover, when the toner amounts in the development devices 5*a* through 5*d* drop, the toner is replenished from the toner bottles 20*a* through 20*d*. The concrete toner replenishment method will be mentioned later.

The sheet S is conveyed to the secondary transfer section 24 in response to the timing at which the image formed on the intermediate transfer belt 7 is conveyed to the secondary transfer area 24. The secondary transfer area 24 is formed on the intermediate transfer belt 7 between the secondary transfer internal roller 8 and a secondary transfer external roller 13. The sheet S sent out by the feed roller pair 17*a* is conveyed towards the registration roller pair 18 through the conveyance path R1. The registration roller pair 18 corrects the skew of the sheet S, and conveys the sheet S to the secondary transfer area 24 after adjusting the timing at which the sheet S is conveyed to the secondary transfer area 24. When the sheet S passes the secondary transfer area 24, a secondary transfer bias is given to the secondary transfer internal roller 8 and the secondary transfer external roller 13. This transfers the image on the intermediate transfer belt 7 to the sheet S. The toner that remained on the intermediate transfer belt 7 without being transferred to the sheet S is removed from the intermediate transfer belt 7 with a blade 12*a* of a belt cleaner 12.

The sheet S to which the color image was transferred is carried in to the fixing device 19. The fixing device 19 is provided with two rollers that face to each other, and a fixing nip position is formed between the two rollers concerned. Furthermore, the fixing device 19 has a heater. While the sheet S passes the fixing nip position, the rollers put pressure on the sheet S, and the heater gives heat to the sheet S. As a result of this, the toner that constitutes the color image on the sheet S melts, and the color image is fixed to the sheet S. The sheet S to which the toner image has been fixed is ejected to a sheet ejection tray 23 through the ejection roller pair 22. When images are formed on the both (front and back) sides of the sheet S, the sheet S on which the image has been formed on the front side is carried in to the inversion path R2, and an image is transferred to the back side of the sheet S in the secondary transfer area 24. Then, the sheet S on which the image concerned was formed is conveyed to the fixing device 19.

Next, the developer replenishment mechanism (referred to as a "toner replenishment mechanism", hereafter) in the image forming apparatus 200 in FIG. 1 will be described. The toner replenishment mechanism supplies the toner as developer to each of the development devices 5*a* through 5*d*. There are four toner replenishment mechanisms corresponding to the image forming units 100Y through 100Bk, respectively. They are the same configurations altogether. Accordingly, the configuration, operation, etc. of the toner replenishment mechanism corresponding to the image forming unit 100Y will be described in detail as an example.

The toner replenishment mechanism is provided with a bottle mounting portion that is built in the image forming apparatus 200, the toner bottle that is mounted on the bottle mounting portion, and a drive motor as a rotating driving source therefor.

Figure 2A:
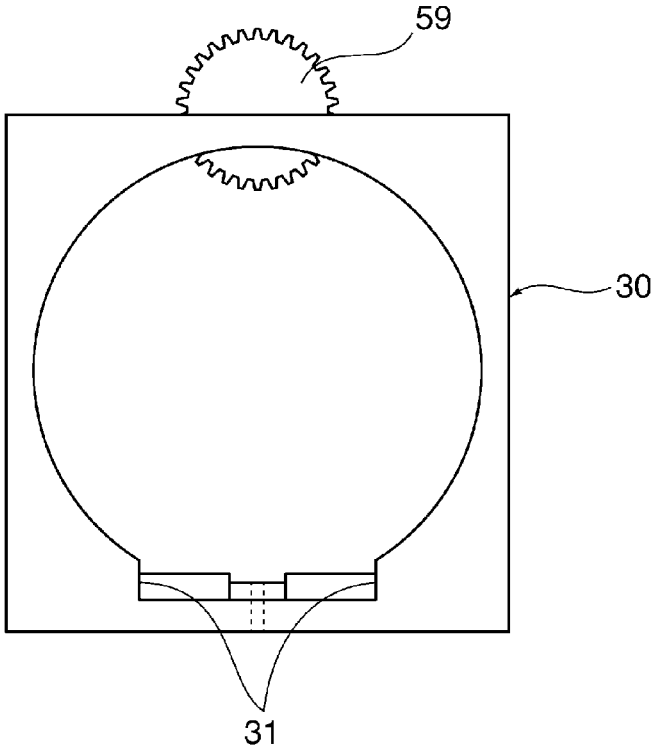
FIG. 2A is a front view showing a main part of a bottle mounting portion included in the image forming apparatus shown in FIG. 1.
Figure 2B:
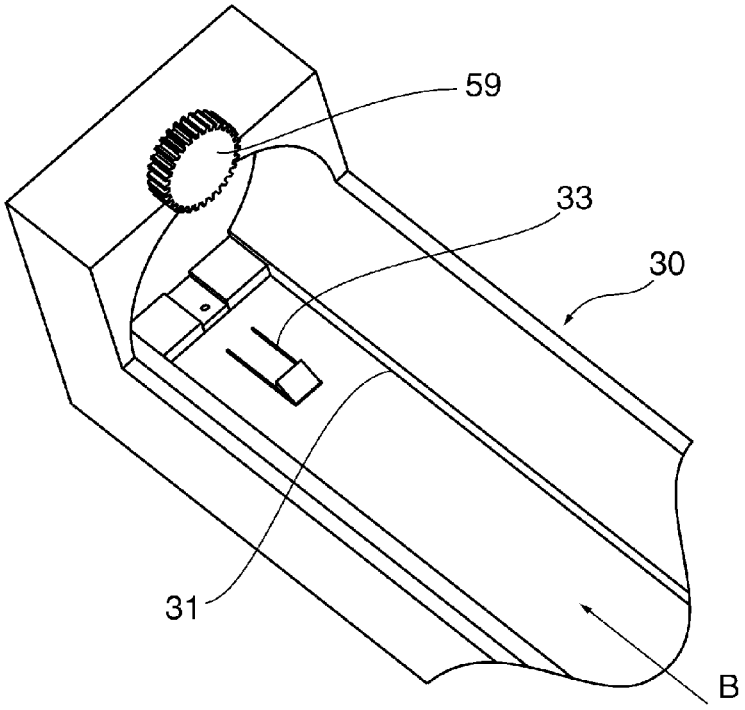
FIG. 2B is a perspective view showing the bottle mounting portion of which a part is cut out, in the image forming apparatus shown in FIG. 1.

FIG. 2A is a front view showing a main part of the bottle mounting portion included in the image forming apparatus 200 shown in FIG. 1. FIG. 2B is a perspective view showing the bottle mounting portion of which a part is cut out.

As shown in FIG. 2A and FIG. 2B, the bottle mounting portion has a mounting portion body 30 and a drive gear 59 that is provided on the mounting portion body 30. A semi-cylindrical concave portion into which the approximately cylindrical toner bottle is fit, and a through hole of generally circular shape in cross section into which an edge of the toner bottle is fit are formed in the mounting portion body 30. When the toner bottle that contains the toner is mounted by sliding in the direction of an arrow B, the drive gear 59 is meshed with a driven gear of the toner bottle, and transmits driving force to the toner bottle. A rotation regulating portion 31 of a step shape that regulates the rotation of a cap (mentioned below) of the toner bottle by engaging with a projection part of the cap is formed on the semi-cylindrical concave portion of the mounting portion body 30 in the longitudinal direction thereof. A slide lock 33 is provided in the bottom of one end of the semi-cylindrical concave portion. The slide lock 33 regulates movement of the toner bottle in a direction of a rotating axis thereof.

Figure 3A:
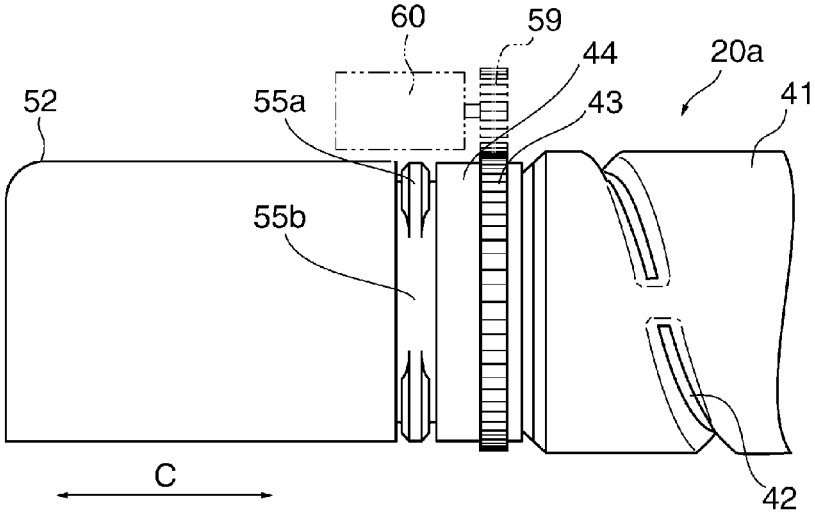
FIG. 3A is an external view of a toner bottle that is mounted to the bottle mounting portion shown in FIG. 2A.
Figure 3B:
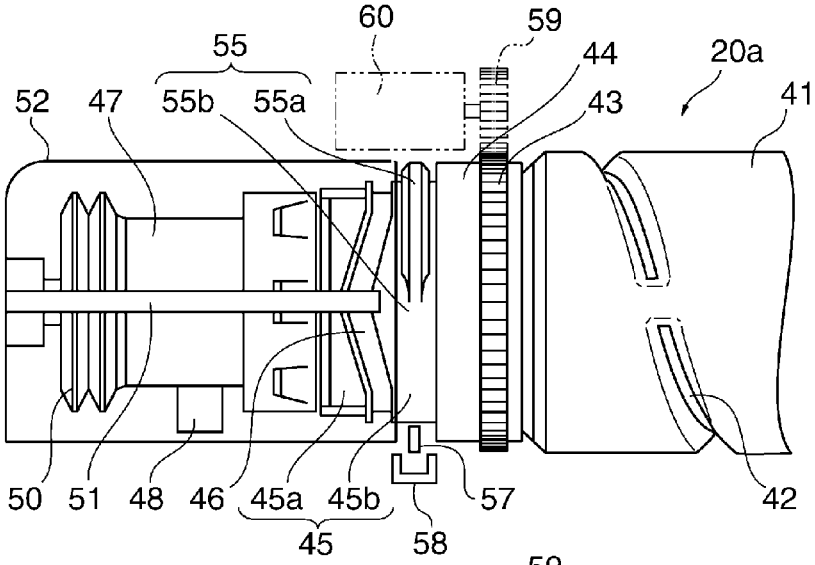
FIG. 3B is a view showing a state where a pump unit of the toner bottle that is mounted to the bottle mounting portion shown in FIG. 2A expands to the maximum.

FIG. 3A is an external view of the toner bottle that is mounted to the bottle mounting portion shown in FIG. 2A. FIG. 3B is a view showing a state where a pump unit of the toner bottle expands to the maximum. Moreover, FIG. 3C is a view showing a state where the pump unit of the toner bottle contracts to the minimum.

Figure 3C:
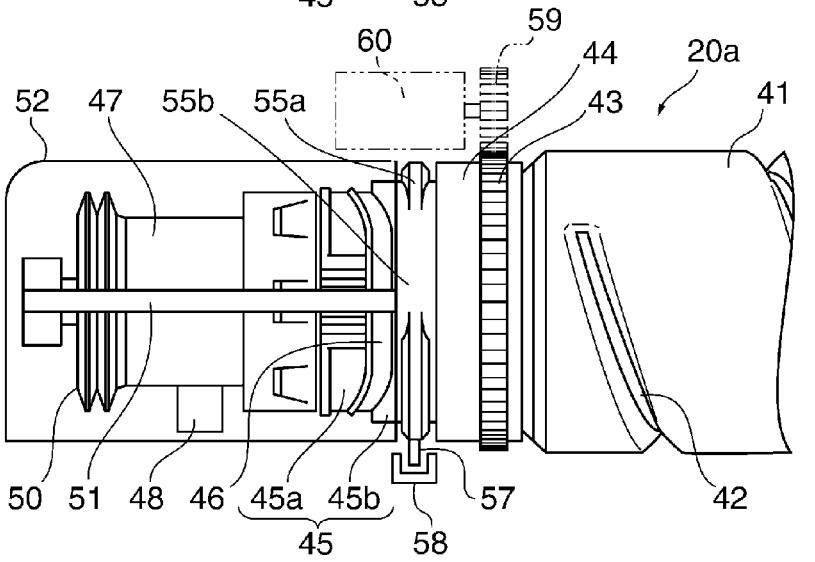
FIG. 3C is a view showing a state where the pump unit of the toner bottle that is mounted to the bottle mounting portion shown in FIG. 2A contracts to the minimum.

As shown in FIG. 3A through FIG. 3C, the toner bottle 20*a* discharges toner toward the development device in synchronization with a rotary action. The toner bottle 20*a* has a chamber 41 that contains toner, a driving force receiving section 44 into which rotational driving force is inputted, a drum section 45 connected with the driving force receiving section 44, a discharging section 47 that discharges toner, and the pump unit 50 that controls pressure in the discharging section 47. Moreover, the toner bottle 20*a* has a reciprocation member 51 connected with the pump unit 50. It should be noted that a part of the drum section 45, the discharging section 47, the pump unit 50, and the reciprocation member 51 are covered with a cap 52.

A driven gear 43 is formed around the driving force receiving section 44 in the circumferential direction. The driven gear 43 meshes with the drive gear 59 of a toner-bottle drive motor (referred to as a "drive motor", hereafter) 60 that drives the toner bottle 20*a*. Rotational driving force is inputted into the driving force receiving section 44 from the drive motor 60 through the drive gear 59 and the driven gear 43.

Conveyance ridges 42 projected spirally are formed on an inner peripheral side of the chamber 41. Accordingly, the toner in the chamber 41 is conveyed to the discharging section 47 as the chamber 41 rotates.

The drum section 45 consists of a small diameter portion 45*a* and a large diameter portion 45*b*. A detected portion 55, which consists of convex parts 55*a* and flat parts 55*b*, is provided on the large diameter portion 45*b* of the drum section 45 around its circumference. A rotation detection sensor 58 is arranged so as to face the detected portion 55. A rotation detection flag 57 is arranged so as to contact with the detected portion 55. When contacting with the convex part 55*a*, the rotation detection flag 57 is moved to the rotation detection sensor 58 and is detected with the rotation detection sensor 58. When contacting with the flat part 55*b*, the rotation detection flag 57 retreats from the rotation detection sensor 58 and is not detected with the rotation detection sensor 58. The two convex parts 55*a* and the two flat parts 55*b* are provided alternately, and the rotation detection sensor 58 repeats the change to the OFF state from the ON state and the change to ON state from the OFF state twice during one rotation of the toner bottle 20*a*.

Moreover, a cam groove 46 that curves in a specific pattern is formed for the whole circumference of the small diameter portion 45*a* of the drum section 45 in the circumferential direction. The toner discharging portion 47 that interconnects with the chamber 41, and the pump unit 50 that connects to the chamber 41 are provided at the opposite side of the chamber 41 with respect to the drum section 45. A discharging port 48 for the toner is provided in the toner discharging portion 47. The diameter of the discharging port 48 is about 2 mm, for example.

The toner discharging portion 47 and the pump unit 50 exhibit approximately cylindrical shapes. The small diameter portion 45*a*, the toner discharging portion 47, and the pump unit 50 are covered with the cap 52. The pump unit 50 is the resin-made pump on which mountain fold parts and valley fold parts are formed alternately, and the reciprocation member 51 is fixed to the tip portion of the pump unit 50. The reciprocation member 51 has hooks (not shown) at the front ends of two arms, and these hooks engage with the cam groove 46.

The reciprocation member 51 and the cam groove 46 with which the reciprocation member 51 is engaged constitute a driving force converting mechanism that converts a part of rotational driving force inputted to the toner bottle 20*a* into linear reciprocation driving force. That is, the drum section 45 rotates with the chamber 41 by means of the rotational driving force inputted to the toner bottle 20*a* from the drive motor 60. When the drum section 45 rotates, the reciprocation member 51 that engages with the cam groove 46 repeats linear motions by reciprocating in a direction of an arrow C. When the reciprocation member 51 reciprocates, the end of the pump unit 50 fixed to its tip portion also reciprocates in the direction of the arrow C. As a result of this, the pump unit 50 repeats expansion (FIG. 3B) and contraction (FIG. 3C), and changes the volume inside the pump unit 50. When the toner bottle 20*a* rotates, the toner in the chamber 41 is conveyed to the toner discharging portion 47 with the conveying ridge 42, and stagnates in the toner discharging portion 47 temporarily. Then, the toner in the toner discharging portion 47 is replenished to the development device from the discharging port 48 in response to the action of the pump unit 50.

The pump unit 50 functions as an air-intake-and-exhaust mechanism that performs an intake operation and an exhaust operation alternately through the discharging port 48. Moreover, since the air intake and exhaust by the pump unit 50 generates an airflow that flows from the discharging port 48 into the toner bottle 20*a* and an airflow that flows from the inside of the toner bottle 20*a* toward the outside of the toner discharging portion 47 through the discharging port 48 alternately, the pump unit 50 functions as an air-flow generation mechanism.

The reciprocation member 51 reciprocates two times in the direction of the arrow C during one rotation of the toner bottle 20*a*, and the pump unit 50 repeats expansion and contraction twice. As a result of this, the toner is intermittently replenished toward the development device (not shown). The toner amount replenished to the development device from the toner bottle 20*a* is calculated based on the pumping count of the pump unit 50 and the rotational velocity of the toner bottle 20*a*. Among these, the pumping count of the pump unit 50 is determined according to the number of rising edges mentioned later.

It should be noted that the outer circumferential surface of the cap 52 has a projection part that is projected outward, and this projection part is fitted to the rotation regulating portion 31 formed on the mounting portion body 30 of the bottle mounting portion to which the toner bottle 20*a* is mounted. Accordingly, the cap 52 of the toner bottle 20*a* does not rotate. Furthermore, since the cap 52 engages with the slide lock 33 that is formed on the mounting portion body 30, the movement in the direction of the arrow C is regulated, and the cap 52 does not reciprocate even when the toner bottle 20*a* rotates. Moreover, the toner discharging portion 47 is connected with the drum section 45 through a slide part, and is regulated by a rotation regulating member (not shown) so as not to rotate. Accordingly, the toner discharging portion 47 and the pump unit 50 do not rotate, even when the drum section 45 rotates.

Next, a control configuration of the toner replenishment system in the image forming apparatus 200 of such a configuration will be described.

Figure 4:
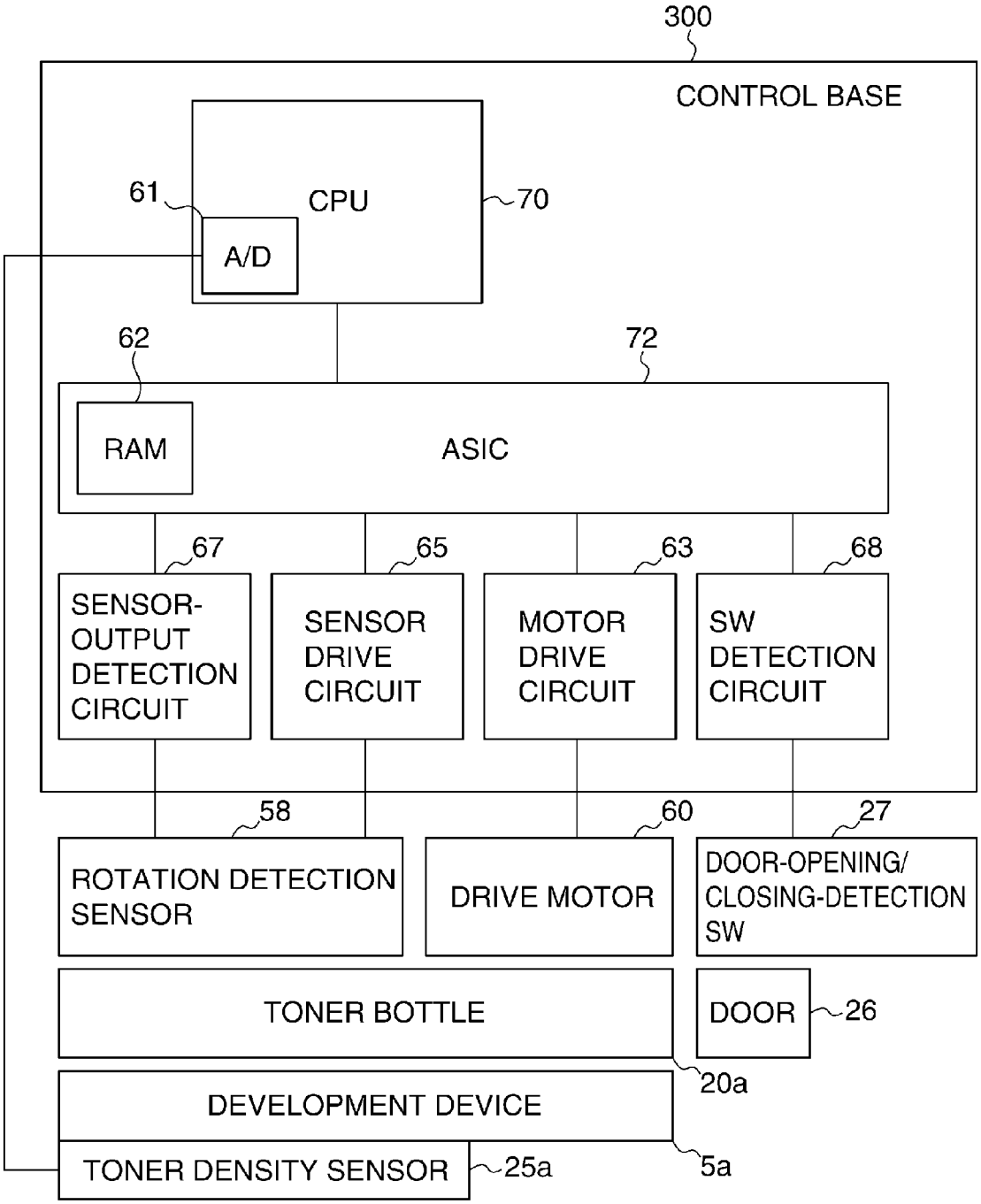
FIG. 4 is a block diagram schematically showing a configuration of a toner replenishment system included in the image forming apparatus shown in FIG. 1.

FIG. 4 is a block diagram schematically showing the configuration of the toner replenishment system included in the image forming apparatus 200 shown in FIG. 1. As shown in FIG. 4, a control base 300 that controls the whole image forming apparatus 200 is provided with a CPU 70 and an ASIC 72 that is hardware having functions about the toner replenishment operation. Since the ASIC 72 controls the toner replenishment operation according to this configuration, the arithmetic process by the CPU 70 is reduced.

Hereinafter, the configuration of the toner replenishment system in which the CPU 70 controls the toner replenishment to the development device 5*a* will be described. And in order to simplify the description, the configurations that control toner replenishments to the other development devices 5*b*, 5*c*, and 5*d* are not described.

The CPU 70 has an A/D converter 61, and is connected with the ASIC 72 equipped with a RAM 62. Furthermore, the A/D converter 61 is connected to the toner density sensor 25*a* arranged in the development device 5*a*. The toner density sensor 25*a* outputs a signal in response to magnetic permeability that varies based on proportion (toner density) of the toner over the developer contained in the development device 5*a*. It should be noted that the toner density sensor 25*a* is replacable with any sensor that can detect the toner density. Moreover, when the developer contained in the development device 5*a* is one-ingredient developer, the toner density sensor 25 is replacable with a sensor that outputs a signal in response to the toner amount in the development device 5*a*.

The ASIC 72 is connected with the rotation detection sensor 58 that detects the rotation information of the toner bottle 20*a* through a sensor drive circuit 65 and a sensor-output detection circuit 67. The ASIC 72 is connected with the drive motor 60 that drives the toner bottle 20*a* through a motor drive circuit 63. Furthermore, the ASIC 72 is connected with a door-opening/closing-detection switch (SW) 27 that detects opening/closing of a door 26 of the image forming apparatus 200 through a SW detection circuit 68. When mounting the toner bottle 20*a* to the bottle mounting portion, a user opens and closes the door 26. It should be noted that the door 26 may open and close automatically, when the toner bottle 20*a* is exchanged.

The motor drive circuit 63 drives the drive motor 60 according to a motor control signal outputted from the ASIC 72. The motor control signal is a PWM (Pulse Width Modulation) signal, for example. This PWM signal represents the rate (DUTY ratio) of time period during which the current is supplied to the drive motor 60 over predetermined time period. When the DUTY ratio increases, the time period during which the current is supplied to the drive motor 60 in the predetermined time period increases, which increases the rotational velocity of the drive motor 60. On the other hand, when the DUTY ratio decreases, the time period during which the current is supplied to the drive motor 60 in the predetermined time period decreases, which decreases the rotational velocity of the drive motor 60.

The rotation detection sensor 58 is driven by the sensor drive circuit 65. When the bottle mounting portion of the image forming apparatus 200 is equipped with the toner bottle 20*a*, the rotation detection sensor 58 detects the rotation information of the toner bottle 20*a*. The output signal (rotation information) of the rotation detection sensor 58 is inputted into the ASIC 72 through the sensor-output detection circuit 67. The ASIC 72 transmits the rotation information to the CPU 70.

The ASIC 72 measures the time period during which the rotation detection sensor 58 is detecting the rotation detection flag 57 in a toner replenishment operation, and stores it to the RAM 62. The ASIC 72 calculates the rotational velocity of the toner bottle 20*a* based on the time period stored in the RAM 62.

The door-opening/closing-detection SW 27 outputs an opening/closing detection signal according to opening and closing of the door 26 of the image forming apparatus 200. The opening/closing detection signal is inputted into the ASIC 72 through the SW detection circuit 68. The ASIC 72 determines whether the door 26 is in an open state or a closed state based on the opening/closing detection signal.

Although the toner replenishment control using the ASIC 72 was described in this embodiment, the CPU 70 may be connected with the motor drive circuit 63, the sensor drive circuit 65, the sensor-output detection circuit 67, and the SW detection circuit 68. Moreover, one or some of the motor drive circuit 63, the sensor drive circuit 65, the sensor-output detection circuit 67, and the SW detection circuits 68 may be connected with the CPU 70.

Next, the image forming process using the image forming apparatus in FIG. 1 will be described in detail with reference to the drawings.

FIG. 5 is a flowchart showing the image forming process using the image forming apparatus in FIG. 1. The CPU 70 or the ASIC 72 arranged on the control base 300 of the image forming apparatus 200 executes this image forming process according to an image forming process program stored in a ROM (not shown).

Incidentally, in order to detect that the toner bottle 20*a* is dismounted from the image forming apparatus using the rotation detection sensor 58 that detects the rotation information of the toner bottle 20*a*, it is necessary to stop the toner bottle 20*a* in a specified state. In the specified state, the rotation detection sensor 58 outputs a specified signal "Hi". Hereinafter, the position of the toner bottle 20*a* in the specified state is referred to as a home position (HP). When the toner bottle stops at the home position, and then, is dismounted, the dismounting of the toner bottle is detected by the change of output signal from the rotation detection sensor 58.

In the embodiment, when the toner bottle 20*a* stops at a position other than the home position, the drive motor 60 rotates the toner bottle again in order to stop the toner bottle at the home position (recovery mode). Since the toner is replenished to the development device also by this re-rotation, it is necessary to correct the toner replenishing amount in the image forming process in order to reduce the excessive replenishment of the toner and to reduce an image defect. The CPU 70 rotates the toner bottle and obtains the rotation information of the toner bottle in order to determine whether the mounting portion body 30 is equipped with the toner bottle. The CPU 70 calculates the toner amount replenished to the development device from the toner bottle 20*a*, while the recovery mode is executed, based on the rotation information obtained. Then, the CPU 70 corrects the toner replenishing amount based on the calculated toner amount while the image forming process for forming an image according to image data is executed. The method of calculating the toner amount replenished to the development device from the toner bottle 20*a* based on the rotation information will be mentioned later. The CPU 70 functions as a determination unit that determines whether the bottle mounting portion was equipped with the toner bottle, and a correction unit that corrects the toner replenishing amount.

As shown in FIG. 5, when the image forming process is started, the CPU 70 monitors the door-opening/closing-detection SW 27 and determines whether the door 26 of the bottle mounting portion is closed. When the opening/closing door 26 is not closed, the CPU 70 stands by until the opening/closing door 26 is closed (step S102).

Figure 6:
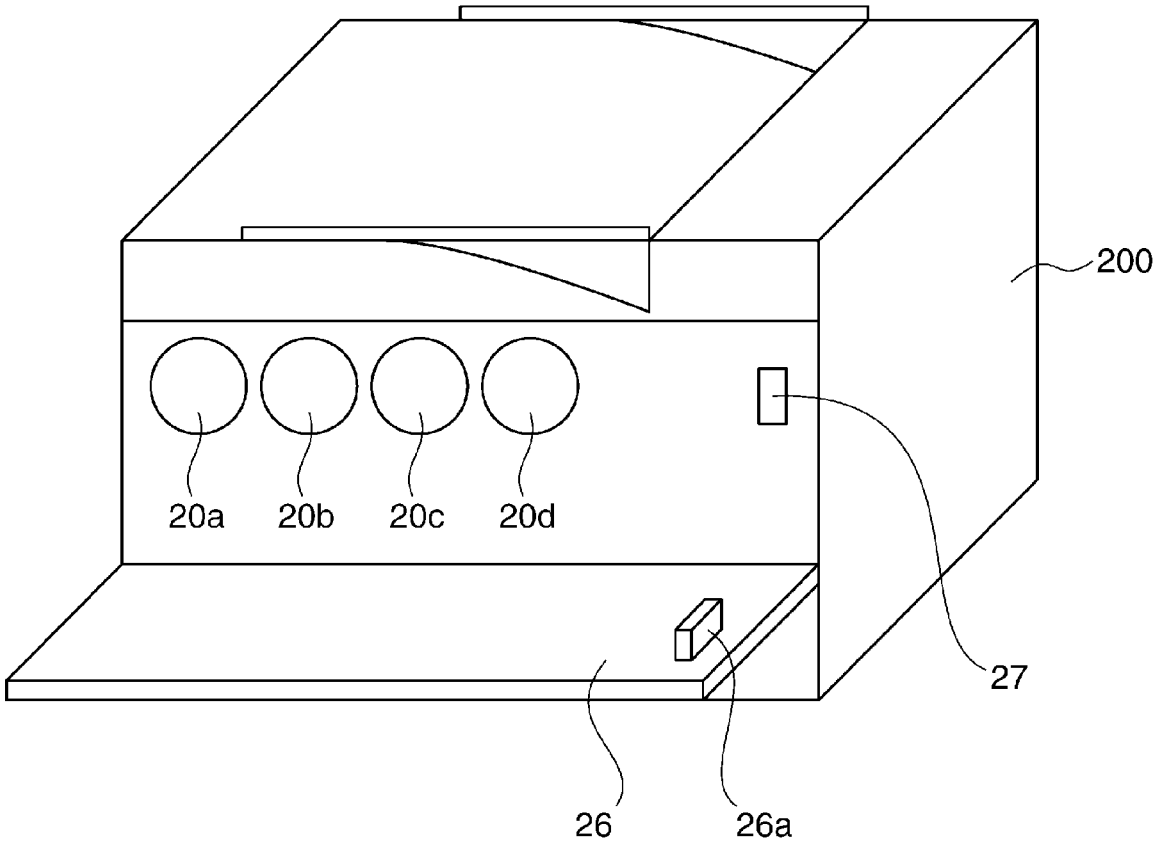
FIG. 6 is a perspective view showing the image forming apparatus according to the first embodiment of the present invention.

FIG. 6 is a perspective view showing the image forming apparatus shown in FIG. 1. As shown in FIG. 6, the image forming apparatus 200 is provided the opening/closing door 26 that opens and closes the bottle mounting portion, and the door-opening/closing-detection SW 27 that detects the open/closed state of the opening/closing door 26. When the opening/closing door is closed, a projection 26*a* formed on the opening/closing door 26 pushes the door-opening/closing-detection SW 27. As a result, the SW 27 detects that the opening/closing door 26 is closed. It should be noted that the opening/closing door 26 may open and close the bottle mounting portion only, or it may open and close the entire area of one side of the image forming apparatus 200.

Returning to FIG. 5, when it is determined that the opening/closing door 26 of the bottle mounting portion is closed ("YES" in the step S102), the CPU 70 determines whether the toner bottle 20*a* that is mounted to the bottle mounting portion has stopped at the home position HP (step S103). In the step S103, the ASIC 72 determines whether the specified signal ("Hi" signal) is outputted from the rotation detection sensor 58 that detects the rotation phase of the toner bottle 20*a*. The ASIC 72 determines that the toner bottle 20*a* has stopped at the home position HP, when the "Hi" signal is outputted from the rotation detection sensor 58.

Figure 7A:
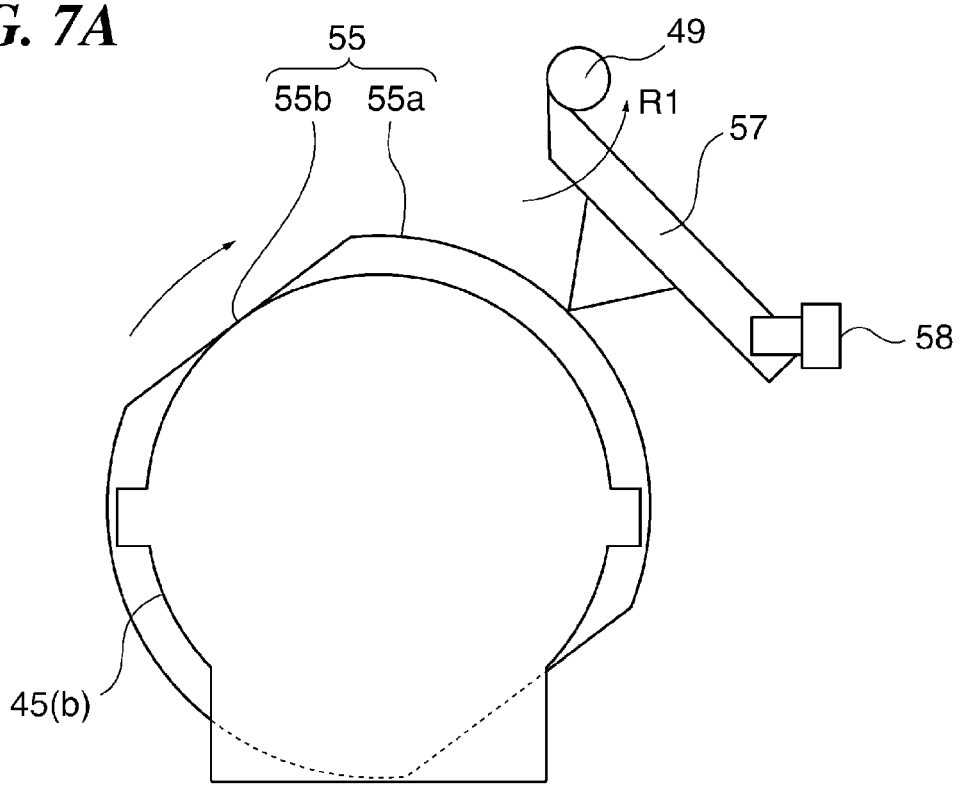
FIG. 7A is a view schematically showing a main part in a state where a rotation detection flag is in contact with a convex part of a detected portion of the toner bottle as shown in FIG. 3C.

FIG. 7A is a view schematically showing a main part in a state where the rotation detection flag 57 is in contact with the convex part 55*a* of the detected portion 55 of the toner bottle as shown in FIG. 3C. Moreover, FIG. 7B is a view schematically the main part in a state where the rotation detection flag 57 is in contact with the flat part 55*b* of the detected portion 55 of the toner bottle as shown in FIG. 3B.

Figure 7B:
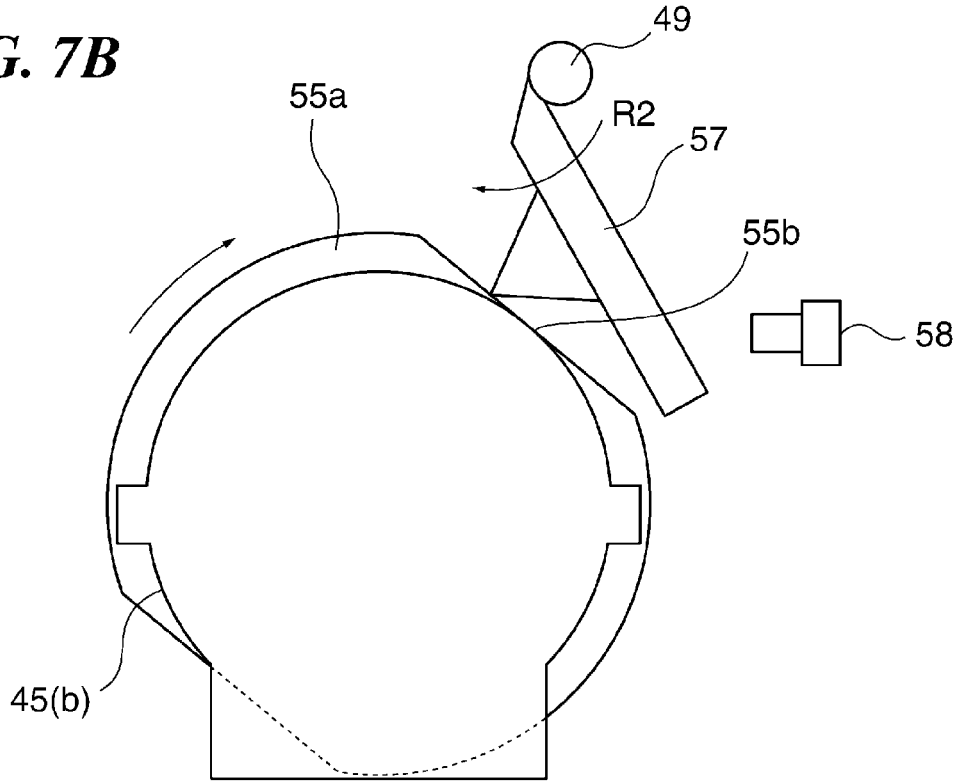
FIG. 7B is a view schematically showing the main part in a state where the rotation detection flag is in contact with a flat part of the detected portion of the toner bottle as shown in FIG. 3B.

As shown in FIG. 7A and FIG. 7B, the rotation detection flag 57 and the rotation detection sensor 58 for detecting the rotation phase of the toner bottle 20*a* are arranged so as to face the detected portion 55 formed on the large diameter portion 45*b* of the drum section 45 of the toner bottle 20*a*. When the rotation detection flag 57 contacts with the convex part 55*a* that rotates with the drum section 45 during the rotation of the drum section 45 of the toner bottle 20*a*, the rotation detection flag 57 swings in an arrow R1 direction in FIG. 7A around a center of a rotating shaft 49. On the other hand, when contacting with the flat part 55*b*, the rotation detection flag 57 swings in an arrow R2 direction in FIG. 7B.

The rotation detection sensor 58 is an optical sensor that has a light emitting section and a light sensing section. When the rotation detection flag 57 exists between the light emitting section and the light sensing section (state in FIG. 7A), the received light amount of the light sensing section is below a threshold. In this case, the "Hi" signal is outputted as a first detection value. On the other hand, when the rotation detection flag 57 does not exist between the light emitting section and the light sensing section (state in FIG. 7B), the received light amount of the light sensing section becomes more than the threshold. In this case, the rotation detection sensor 58 outputs the "Low" signal as a second detection value. That is, the output signal of the rotation detection sensor 58 varies from the "Low" signal that does not detect the rotation detection flag 57 to the "Hi" signal that detects the rotation detection flag 57, and varies from the "Hi" signal to the "Low" signal according to the rotation of the toner bottle 20*a*.

The detected portion 55 and the rotation detection flag 57 are arranged so that the rotation detection flag 57 contacts with the flat part 55*b* in the period during which the pump unit 50 contracts, i.e., the toner bottle 20*a* discharges the toner, and so that the toner discharging operation is completed when the rotation detection flag 57 contacts with the end of the flat part 55*b*.

Figure 8:
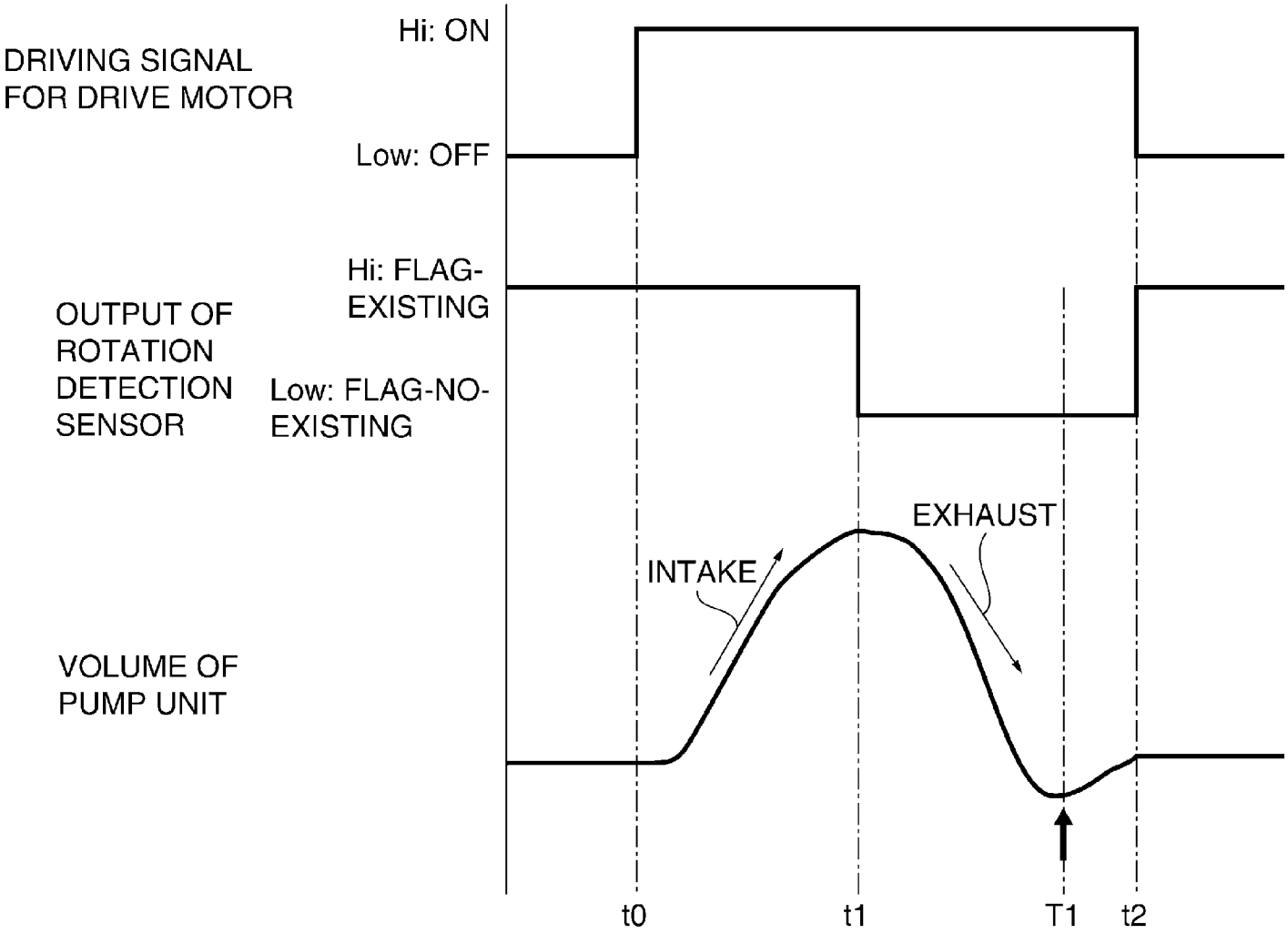
FIG. 8 is a timing chart showing a toner replenishment operation of the toner bottle.

FIG. 8 is a timing chart showing the toner replenishment operation of the toner bottle. As shown in FIG. 8, when the drive motor is started at a timing t0, the toner bottle 20*a* rotates, and the output of the rotation detection sensor 58 varies from the "Hi" signal corresponding to the flag-existing state to the "Low" signal corresponding to the flag-no-existing state at a timing t1, and varies from the "Low" signal to the "Hi" signal at a timing t2 after that. At this time, the pump unit 50 of the toner bottle performs the intake operation between the timing t0 and the timing t1, and performs the exhaust operation for discharging the toner towards the development device between the timing t1 and the timing t2. Then, the output of the rotation detection sensor 58 varies from the "Low" signal to the "Hi" signal at the timing t2 after a timing T1 at which the toner discharging operation completes. Thus, the turning point at which the output of the rotation detection sensor 58 varies from the "Low" signal to the "Hi" signal corresponds to the termination point of the toner discharging operation. Hereinafter, the specific rotation information that represents the turning point at which the output of the rotation detection sensor 58 varies from the "Low" signal to the "Hi" signal, i.e., the turning point at which a non-specified signal varies to a specified signal, is referred to as a rising edge.

The pumping count of the pump unit 50 is obtained by counting the detection count of this specific rotation information (rising edge). The toner replenishing amount replenished to the development device 5*a* from the toner bottle 20*a* can be presumed based on this pumping count and the rotational velocity of the toner bottle. The CPU 70 calculates the toner amount X1 that should be replenished to the development device 5*a* based on the image data inputted through an interface (not shown), and calculates the toner amount X2 that should be replenished to the development device based on the detection result of the toner density sensor 25*a*. The CPU 70 determines the toner replenishing amount X that should be replenished to the development device 5*a* by adding the above-mentioned toner amounts X1 and X2. Next, when the detecting operation (recovery mode) that the drive motor 60 rotates the toner bottle is executed so as to stop the toner bottle at the home position, the CPU 70 calculates the toner amount ΔX replenished to the development device from the toner bottle by the rotation of the toner bottle while the recovery mode is executed. The toner replenishing amount X is corrected according to the toner amount ΔX calculated. Then, the CPU 70 determines the detection count of the rising edges that is equivalent to the replenishing toner amount after correction based on the rotational velocity of the toner bottle while the recovery mode is executed, the pumping count of the pump unit 50, and the toner replenishing amount per one pumping. The CPU 70 rotates the toner bottle until the detection count of the rising edges by the rotation detection sensor 58 reaches the detection count determined.

Based on the output of the rotation detection sensor 58 that detects the toner replenishment operation synchronizing with the rotation phase of the toner bottle 20*a*, it is determined whether the bottle mounting portion of the image forming apparatus 200 is equipped with the toner bottle.

Figure 9A:
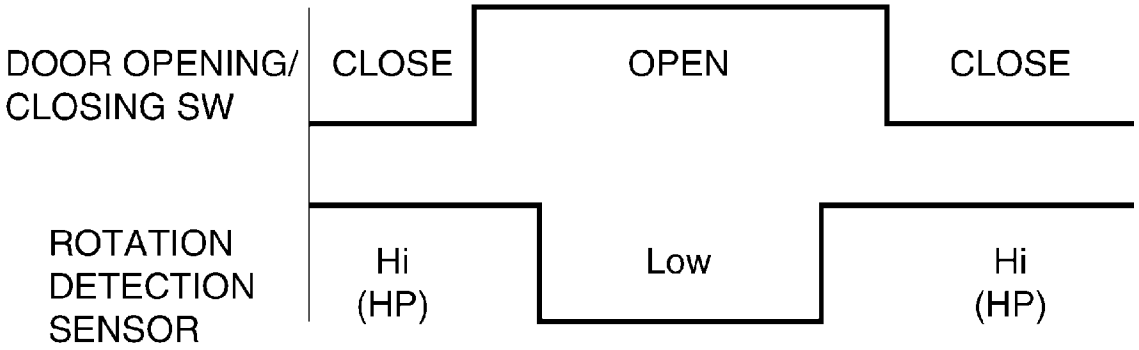
FIG. 9A and FIG. 9B are views showing output signals of a door opening/closing SW and output timings of output signals of a rotation detection sensor.
Figure 9B:
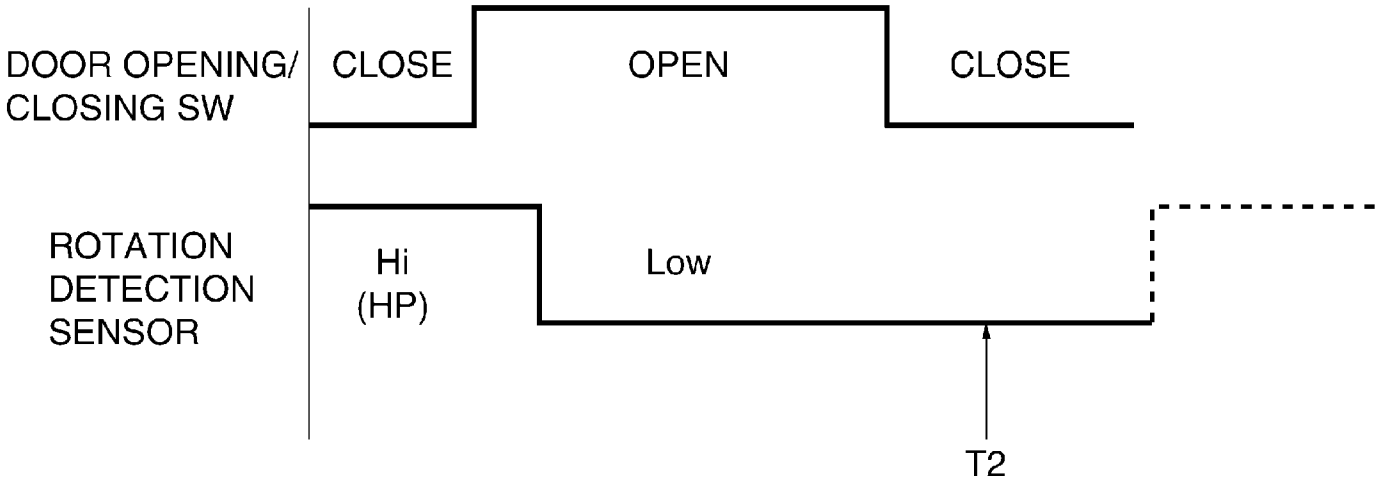

FIG. 9A and FIG. 9B are views showing output signals of the door opening/closing SW and output timings of output signals of the rotation detection sensor. The operation for determining whether the bottle mounting portion of the image forming apparatus 200 is equipped with the toner bottle will be described using FIG. 9A and FIG. 9B.

In FIG. 9A and FIG. 9B, when the toner replenishment operation is not executed, the toner bottle 20*a* has stopped at the home position (HP) at which the rotation detection sensor 58 outputs the "Hi" signal in order to allow detecting whether the toner bottle 20*a* is mounted or not. Moreover, when the toner bottle 20*a* has stopped at the HP, the opening/closing door 26 is closed usually as shown in FIG. 9A and the SW detection circuit 68 connected to the door-opening/closing-detection SW 27 outputs the signal corresponding to the closed state. After the opening/closing door 26 is changed from the closed state to the open state, the output signal of the rotation detection sensor 58 varies from the "Hi" signal corresponding to the flag-existing state to the "Low" signal corresponding to the flag-no-existing state. Then, the output signal of the rotation detection sensor 58 varies from the "Low" signal corresponding to the flag-existing state to the "Hi" signal corresponding to the flag-no-existing state, while the opening/closing door 26 keeps the open state, Then, when the opening/closing door 26 varies from the open state to the closed state, it is determined that the toner bottle 20*a* was mounted again to the bottle mounting portion after the toner bottle 20*a* was dismounted from the bottle mounting portion.

Moreover, as shown in FIG. 9B, when the output of the rotation detection sensor 58 varies from the "Hi" signal corresponding to the flag-existing state to the "Low" signal corresponding to the flag-no-existing state after the opening/closing door 26 varies from the closed state to the open state, and then the opening/closing door 26 varies from the open state to the closed state, it can be detected that the toner bottle 20*a* was dismounted from the bottle mounting portion. However, the opening/closing door 26 varies from the open state to the closed state without detecting whether the bottle mounting portion is again equipped with the toner bottle 20*a*. At this time, it is assumed that the opening/closing door 26 was closed without mounting the toner bottle 20*a* to the bottle mounting portion or the flag position of the toner bottle 20*a* that was mounted to the bottle mounting portion again was shifted from the HP.

The image forming apparatus of the present invention performs the recovery mode (see steps S105 through S110 in FIG. 5) at the timing T2 shown by the arrow in FIG. 9B in order to check whether the toner bottle is mounted.

The recovery mode is a mode in which the ASIC 72 rotates the toner bottle 20*a* with the drive motor 60 until the rotation detection flag 57 is detected by the rotation detection sensor 58. The recovery mode is executed when the rotation detection flag 57 of the toner bottle 20*a* is not detected by the rotation detection sensor 58 even when a user exchanged the toner bottle 20*a*. That is, the recovery mode is executed when the signal corresponding to the flag-existing state is not outputted from the rotation detection sensor, even though the signal outputted from the SW detection circuit varied from the signal corresponding to the open state to the signal corresponding to the closed state. It should be noted that the recovery mode may be executed when the toner bottle 20*a* stops rotation with termination of the replenishment operation, and when the rotation detection flag 57 of the toner bottle 20*a* is not detected by the rotation detection sensor 58.

Thus, the toner bottle 20*a* is stopped at the home position at which the rotation detection sensor 58 outputs the "Hi" signal, and then, the dismounting is detected by the "Low" signal, after that, the mounting of the toner bottle is detected by the "Hi" signal.

Incidentally, since the toner bottle 20*a* rotates also by executing the recovery mode, the toner is replenished to the development device 5*a* from the toner bottle 20*a*. consequently, when the recovery mode is executed, flag data is set to 1. It should be noted that the flag data is set to 0 when the first replenishment is performed after executing the recovery mode. When the flag data is set to 1, the computed result of the toner replenishing amount X that should be replenished to the development device 5*a* from the toner bottle 20*a* is corrected.

Returning to FIG. 5, when determining that the toner bottle 20*a* has stopped at the home position HP in the step 103 ("YES" in the step S103), the CPU 70 drives the drive motor 60 to start a multiple pre-rotation of the toner bottle 20*a* (step S104). The multiple pre-rotation is a preparing operation that rotates the toner bottle 20*a* and prepares an image formation before starting the image forming process.

Next, the CPU 70 finishes the multiple pre-rotation (preparing operation) of the toner bottle 20*a* during the predetermined time (step S111), and shifts the image forming apparatus 200 to the state in which the image formation is possible. After that, the CPU 70 waits until a job that consists of image data is transmitted to the image forming apparatus (step S112). When the job is transmitted to the image forming apparatus ("YES" in the step S112), the CPU 70 analyzes the image data included in the above-mentioned job, and starts an image forming operation (step S113). When replenishment of the toner is required during the image forming operation, the CPU 70 starts the toner replenishment from the toner bottle 20*a* to the development device 5*a* (step S114). At this time, the CPU 70 determines whether the flag data is set to 1, i.e., whether the recovery mode was executed (step S115). When the flag data is set to 1 ("YES" in the step S115), the CPU 70 corrects the toner replenishing amount X, which is calculated based on the image data and the toner density in the development device 5*a*, based on the pumping count of the pump unit 50 during the recovery mode. That is, the CPU 70 establishes the actual replenishing amount by subtracting the toner amount ΔX replenished to the development device from the toner bottle 20*a* during the recovery mode from the replenishing amount X calculated (step S116). On the other hand, when the flag data is not set to 1 ("NO" in the step S115), the CPU establishes the toner replenishing amount X calculated based on the image data and the toner density as the actual replenishing amount without correction (step S117).

The replenishing amount X calculated based on the image data and the toner density is determined based on a video count value calculated based on image data, and a difference between the detection result of the toner density sensor 25*a* and a target value, for example. Moreover, the toner amount ΔX replenished to the development device 5*a* from the toner bottle 20*a* during the recovery mode is determined based on the rotational velocity of the toner bottle 20*a* and a rotation count during the recovery mode. The ASIC 72 calculates the replenished toner amount ΔX based on the rotational velocity of the toner bottle 20*a* and the pumping count of the pump unit 50 during the recovery mode.

Figure 10A:
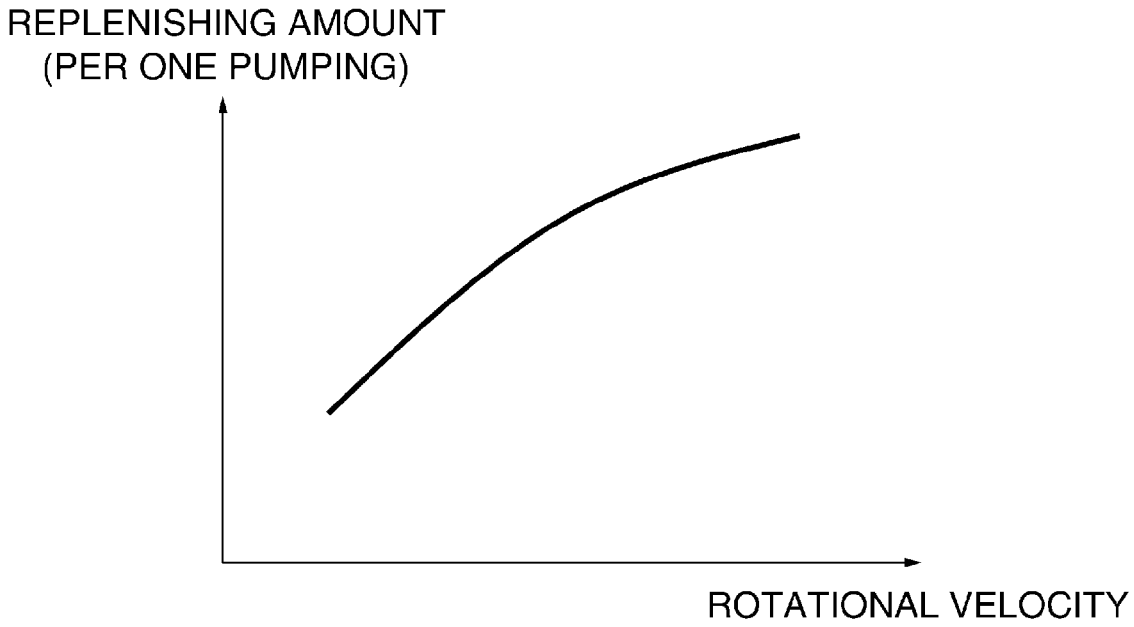
FIG. 10A and FIG. 10B are views showing relations between a rotational velocity of the toner bottle and a toner replenishing amount.
Figure 10B:
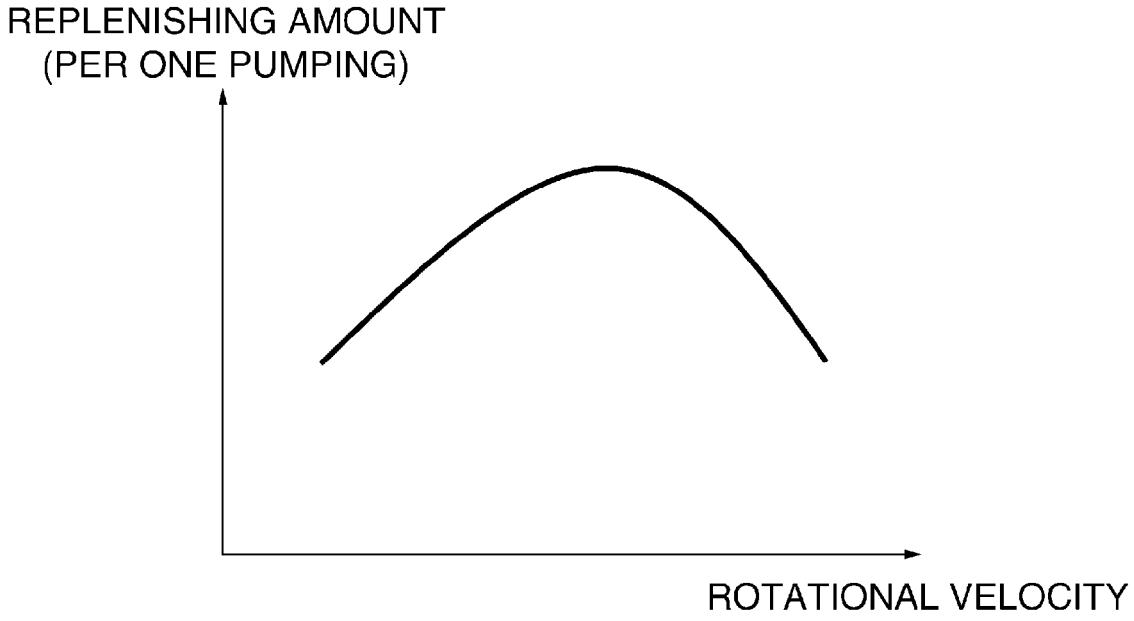

FIG. 10A and FIG. 10B are views showing relations between the rotational velocity of the toner bottle and the toner replenishing amount per one pumping of the pump unit 50. FIG. 10A is a view showing a case having characteristics where the replenishing amount per one pumping of the pump unit 50 monotonically increases as the rotational velocity of the toner bottle increases. Moreover, FIG. 10B is a view showing a case having characteristics where the replenishing amount per one pumping of the pump unit 50 does not monotonically increase as the rotational velocity of the toner bottle increases.

In either case of FIG. 10A and FIG. 10B, when the characteristics are grasped beforehand, the replenishing amount per one pumping can be calculated by detecting the rotational velocity of the toner bottle 20*a*. The ASIC 72 calculates the toner amount ΔX based on the rotational velocity of the toner bottle 20*a* and the pumping counts of the pump unit 50 with reference to the data that represents the correlation with the replenishing amount per one pumping of the pump unit 50.

Returning to FIG. 5, after establishing the toner replenishing amount in the step S116 or S117, the CPU 70 replenishes the toner equivalent to the replenishing amount established to the development device 5*a* (step S118). After the toner of the necessary amount is replenished, the CPU 70 suspends the toner replenishment (step S119), stops the image formation with termination of the image formation according to the job contents (step S120), and finishes this process.

On the other hand, when the toner bottle 20*a* has not stopped at the home position HP ("NO" in the step S103), the CPU 70 executes the recovery mode. That is, the CPU 70 starts rotating the toner bottle 20*a* in order to check whether the toner bottle 20*a* is mounted (step S105). Next, the CPU 70 checks whether the output of the rotation detection sensor 58 varies from the "Low" signal to the "Hi" signal, while the toner bottle 20*a* is rotating (step S106). When the output of the rotation detection sensor 58 varies from the "Low" signal to the "Hi" signal ("YES" in the step S106), the CPU 70 determines that the toner bottle 20*a* is mounted to the bottle mounting portion, and then, stops the rotation of the toner bottle 20*a* at the home position HP (step S107). Next, the CPU 70 sets the flag data to 1 for representing that the recovery mode has executed (step S108), and proceeds with the process to the multiple pre-rotating operation in the step S104.

On the other hand, when the output of the rotation detection sensor 58 does not vary from the "Low" signal to the "Hi" signal and the mounting of the toner bottle 20*a* cannot be detected ("NO" in the step S106), the CPU 70 determines whether a predetermined time period elapsed (step S109). That is, the CPU 70 determines whether the predetermined time period elapsed after starting the rotation of the toner bottle 20*a* in the step S105. Then, when the predetermined time period does not elapse ("NO" in the step S109), the CPU 70 returns the process to the step S106 and determines again whether the output of the rotation detection sensor 58 varies from the "Low" signal to the "Hi" signal. On the other hand, when the predetermined time period elapsed ("YES" in the step S109), the CPU 70 determines that the image forming apparatus 200 is not equipped with the toner bottle 20*a*, indicates that the toner bottle is not mounted on a display panel (not shown) (step S110), and finishes this process.

The predetermined time period used in the step S109 is set so that the output of the rotation detection sensor 58 varies one or more times in the predetermined time period during the rotation of the toner bottle 20*a*. Specifically, the predetermined time period is set so as to be longer than the time period for one pumping operation.

According to the process in FIG. 5, the recovery mode that rotates the toner bottle 20*a* in order to check whether the toner bottle 20*a* is mounted may be executed. Then, when the recovery mode is executed, the toner amount ΔX replenished to the development device 5*a* from the toner bottle 20*a* during the recovery mode is subtracted from the replenishing amount X of the next toner replenishment. Since the excessive replenishment of the toner to the development device 5*a* is prevented by such a process, an image density is stabilized and influence resulting from the excessive replenishment of the toner to the development device 5*a*, for example, an image defect, toner clogging, etc. can be reduced.

It should be noted that the rotational velocity of the toner bottle 20*a* in the recovery mode is controlled to become slower than the rotational velocity of the regular toner replenishment. This facilitates stopping of the toner bottle 20*a* at the HP when the recovery mode is executed. Moreover, the toner bottle 20*a* rotates more than ½ rotations at least in the recovery mode. For example, the toner bottle 20*a* is rotated so that the toner bottle 20*a* may stop at the home position HP after two rotations.

According to the embodiment, the CPU 70 detects the dismounting of the toner bottle 20*a* by detecting the change of the output of the rotation detection sensor 58 from the "Hi" signal to the "Low" signal, and then, detects the mounting of the toner bottle by detecting the change of the output of the rotation detection sensor 58 to the "Hi" signal again.

According to the embodiment, when two-ingredient developer that is mixture of toner and carrier is used as the toner contained in the toner bottle 20*a*, the excessive replenishment of not only the toner but also the carrier to the development device 5*a* is prevented.

Moreover, the toner replenishing amount is calculated based on the rotational velocity of the toner bottle 20*a* and the pumping count of the pump unit 50. However, a measurement unit may be mounted on the toner bottle 20*a* to measure the toner replenishing amount.

Moreover, the rotation detection sensor 58 is not limited to what detects a motion of the rotation detection flag 57. When a specified mark is formed on the toner bottle 20*a*, the rotation detection sensor 58 may detect the rotation information of the toner bottle based on the reading count of the mark concerned.

Next, a second embodiment of the present invention will be described with reference to FIG. 11. An image forming apparatus in the second embodiment has a similar configuration to the image forming apparatus 200 in the first embodiment.

FIG. 11 is a flowchart showing an image forming process (a second image forming process) according to the second embodiment of the present invention. The second image forming process is executed by the CPU 70 or the ASIC 72 arranged on the control base 300 of the image forming apparatus 200 according to a second image forming process program stored in a ROM (not shown). In this image forming process, it is controlled so as to check whether the toner bottle 20*a* is mounted just after a timing at which the electric power is supplied to the image forming apparatus 200.

As shown in FIG. 11, when the second image forming process is started and the power source is supplied to the image forming apparatus 200 for starting (step S201), the CPU 70 first determines whether the toner bottle 20*a* has stopped at the home position HP (step S202). When determining that the rotation detection sensor 58 outputs the "Hi" signal and the toner bottle 20*a* has stopped at the home position HP ("YES" in the step S202), the CPU 70 drives the drive motor 60 to start a multiple pre-rotation of the toner bottle 20*a* (step S203).

Next, the CPU 70 finishes the multiple pre-rotation (preparing operation) of the toner bottle 20*a* during the predetermined time (step S210), and shifts the image forming apparatus 200 to the state in which the image formation is possible. After that, the CPU 70 waits until a job that consists of image data is transmitted to the image forming apparatus (step S211). When the job is transmitted to the image forming apparatus ("YES" in the step S211), the CPU 70 analyzes the image data included in the above-mentioned job, and starts an image forming operation (step S212). When replenishment of the toner is required during the image forming operation, the CPU 70 starts the toner replenishment from the toner bottle 20*a* to the development device 5*a* (step S213). At this time, the CPU 70 determines whether the flag data is set to 1, i.e., whether the recovery mode was executed (step S214). When the flag data is set to 1 ("YES" in the step S214), the CPU 70 corrects the toner replenishing amount X, which is calculated based on the image data and the toner density in the development device 5*a*, based on the pumping count of the pump unit 50 during the recovery mode. That is, the CPU 70 establishes the actual replenishing amount by subtracting the toner amount ΔX replenished to the development device from the toner bottle 20*a* during the recovery mode from the replenishing amount X calculated (step S215). On the other hand, when the flag data is not set to 1 ("NO" in the step S214), the CPU establishes the toner replenishing amount X calculated based on the image data and the toner density as the actual replenishing amount without correction (step S216). It should be noted that the toner replenishing amount X calculated is established as the actual replenishing amount when the toner amount ΔX replenished by the rotation during the recovery mode is zero.

The replenishing amount X calculated based on the image data and the toner density is determined based on a video count value calculated based on image data, and a difference between the detection result of the toner density sensor 25*a* and a target value, for example. Moreover, the toner amount ΔX replenished to the development device 5*a* from the toner bottle 20*a* during the recovery mode is determined based on the rotational velocity of the toner bottle 20*a* and a rotation count during the recovery mode. Moreover, it is also detectable whether the toner was replenished to the development device 5*a* in the recovery mode based on a variation of the output of the toner density sensor 25*a* in the development device 5*a*.

After establishing the toner replenishing amount in the step S215 or S216, the CPU 70 replenishes the toner equivalent to the replenishing amount established to the development device 5*a* (step S217). After the toner of the necessary amount is replenished, the CPU 70 suspends the toner replenishment (step S218), stops the image formation with termination of the image formation operation according to the job contents (step S219), and finishes this process.

On the other hand, when the toner bottle 20*a* has not stopped at the home position HP ("NO" in the step S202), the CPU 70 executes the recovery mode. That is, the CPU 70 starts rotating the toner bottle 20*a* in order to check whether the toner bottle 20*a* is mounted (step S204). Next, the CPU 70 checks whether the output of the rotation detection sensor 58 varies from the "Low" signal to the "Hi" signal, while the toner bottle 20*a* is rotating (step S205). When the output of the rotation detection sensor 58 varies from the "Low" signal to the "Hi" signal ("YES" in the step S205), the CPU 70 determines that the toner bottle 20*a* is mounted to the bottle mounting portion, and then, stops the rotation of the toner bottle 20*a* at the home position HP (step S206). Next, the CPU 70 sets the flag data to 1 for representing that the recovery mode has executed (step S207), and proceeds with the process to the multiple pre-rotating operation in the step S203.

On the other hand, when the output of the rotation detection sensor 58 does not vary from the "Low" signal to the "Hi" signal and the mounting of the toner bottle 20*a* cannot be detected ("NO" in the step S205), the CPU 70 determines whether a predetermined time period elapsed (step S208). That is, the CPU 70 determines whether the predetermined time period elapsed after starting the rotation of the toner bottle 20*a* in the step S204. Then, when the predetermined time period does not elapse ("NO" in the step S208), the CPU 70 returns the process to the step S205 and determines again whether the output of the rotation detection sensor 58 varies from the "Low" signal to the "Hi" signal. On the other hand, when the predetermined time period elapsed ("YES" in the step S208), the CPU 70 determines that the image forming apparatus 200 is not equipped with the toner bottle 20*a*, indicates that the toner bottle is not mounted on a display panel (not shown) (step S209), and finishes this process. The predetermined time period used in the step S208 is set so that the output of the rotation detection sensor 58 varies one or more times in the predetermined time period during the rotation of the toner bottle 20*a*. Specifically, the predetermined time period is set so as to be longer than the time period for one pumping operation.

According to process in FIG. 11, since it is checked whether the toner bottle 20*a* is mounted just after the timing at which the electric power is supplied to the image forming apparatus 200 (the step S202), the recovery mode is executed promptly if needed. Moreover, when the recovery mode is executed, the toner amount ΔX replenished to the development device 5*a* from the toner bottle 20*a* during the recovery mode is subtracted from the replenishing amount X of the next toner replenishment. This prevents the excessive replenishment of the toner to the development device 5*a*, and reduces an image defect.

According to the embodiment, when two-ingredient developer that is mixture of toner and carrier is used as the toner contained in the toner bottle 20*a*, the excessive replenishment of not only the toner but also the carrier to the development device 5*a* is prevented.

Moreover, a measurement unit may be mounted on the toner bottle 20*a* to measure the toner replenishing amount. Furthermore, when a specified mark is formed on the toner bottle 20*a*, the rotation detection sensor 58 may detect the rotation information of the toner bottle based on the reading count of the mark concerned.

Next, a third embodiment will be described with reference to FIG. 12. An image forming apparatus in the third embodiment has a similar configuration to the image forming apparatus 200 in the first embodiment.

FIG. 12 is a flowchart showing an image forming process (a third image forming process) according to the third embodiment. This image forming process is executed by the CPU 70 or the ASIC 72 arranged on the control base 300 of the image forming apparatus 200 according to a third image forming process program stored in a ROM (not shown). In the third image forming process, when the remaining toner amount in the toner bottle 20*a* (in a container) diminishes and a toner replenishment capability declines, it is controlled not to correct a toner replenishing amount but to replenish the toner of the replenishing amount calculated based on image data and the toner density in the development device 5*a*.

As shown in FIG. 12, when the third image forming process is started, the CPU 70 checks the door-opening/closing-detection SW 27 to determine whether the opening/closing door 26 of the bottle mounting portion is closed. It should be noted that the CPU 70 waits until the opening/closing door 26 is closed, when the opening/closing door 26 is not closed (step S302).

Next, when determining that the opening/closing door 26 of the bottle mounting portion is closed ("YES" in the step S302), the CPU 70 determines whether the toner bottle 20*a* mounted to the bottle mounting portion has stopped at the home position HP (step S303).

When determining that the rotation detection sensor 58 outputs the "Hi" signal and the toner bottle 20*a* has stopped at the home position HP ("YES" in the step S303), the CPU 70 drives the drive motor 60 to start a multiple pre-rotation of the toner bottle 20*a* (step S304).

Next, the CPU 70 finishes the multiple pre-rotation (preparing operation) of the toner bottle 20*a* during the predetermined time (step S312), and shifts the image forming apparatus 200 to the state in which the image formation is possible. After that, the CPU 70 waits until a job that consists of image data is transmitted to the image forming apparatus (step S313). When the job is transmitted to the image forming apparatus ("YES" in the step S313), the CPU 70 analyzes the image data included in the above-mentioned job, and starts an image forming operation (step S314). When replenishment of the toner is required during the image forming operation, the CPU 70 starts the toner replenishment from the toner bottle 20*a* to the development device 5*a* (step S315). At this time, the CPU 70 determines whether the flag data is set to 1, i.e., whether the recovery mode was executed (step S316). When the flag data is set to 1 ("YES" in the step S316), the CPU 70 corrects the toner replenishing amount X, which is calculated based on the image data and the toner density in the development device 5*a*. That is, the CPU 70 establishes the actual replenishing amount by subtracting the toner amount ΔX replenished to the development device from the toner bottle 20*a* during the recovery mode from the replenishing amount X calculated (step S317). On the other hand, when the flag data is not set to 1 ("NO" in the step S316), the CPU 70 establishes the toner replenishing amount X calculated based on the image data and the toner density as the actual replenishing amount without correction (step S318). It should be noted that the toner replenishing amount X calculated is established as the actual replenishing amount when the toner amount ΔX replenished by the rotation during the recovery mode is zero.

The replenishing amount X calculated based on the image data and the toner density is determined based on a video count value calculated based on image data, and a difference between the detection result of the toner density sensor 25*a* and a target value, for example. Moreover, the toner amount ΔX replenished to the development device 5*a* from the toner bottle 20*a* during the recovery mode is determined based on the rotational velocity of the toner bottle 20*a* and a rotation count during the recovery mode.

After establishing the toner replenishing amount in the step S317 or S318, the CPU 70 replenishes the toner equivalent to the replenishing amount established to the development device 5*a* (step S319). After the toner of the necessary amount is replenished, the CPU 70 suspends the toner replenishment (step S320), stops the image formation with termination of the image formation operation according to the job contents (step S321), and finishes this process.

On the other hand, when the toner bottle 20*a* has not stopped at the home position HP ("NO" in the step S303), the CPU 70 executes the recovery mode. That is, the CPU 70 starts rotating the toner bottle 20*a* in order to check whether the toner bottle 20*a* is mounted (step S305). Next, the CPU 70 checks whether the output of the rotation detection sensor 58 varies from the "Low" signal to the "Hi" signal, while the toner bottle 20*a* is rotating (step S306). When the output of the rotation detection sensor 58 varies from the "Low" signal to the "Hi" signal ("YES" in the step S306), the CPU 70 determines that the toner bottle 20*a* is mounted to the bottle mounting portion, and then, stops the rotation of the toner bottle 20*a* at the home position HP (step S307). Next, the CPU 70 determines whether the output of the toner density sensor 25*a* of the development device 5*a* varied beyond a specified value (step S308). When the output varied beyond the specified value ("YES" in the step S308), the CPU 70 sets the flag data to 1 for representing that the recovery mode has executed (step S309), and proceeds with the process to the multiple pre-rotating operation in the step S304.

On the other hand, when the output of the toner density sensor 25*a* did not vary beyond the specified value ("NO" in the step S308), the CPU 70 proceeds with the process to the multiple pre-rotating process (step S304) without setting the flag data To 1. In this case, it is determined that the toner bottle 20*a* rotated but the toner was not replenished. When the remaining toner amount in the toner bottle 20*a* is insufficient, the toner is not replenished even though the toner bottle 20*a* rotates. Accordingly, an appropriate operation corresponding to the decline of the remaining toner amount in the toner bottle, etc. is performed.

Figure 13A:
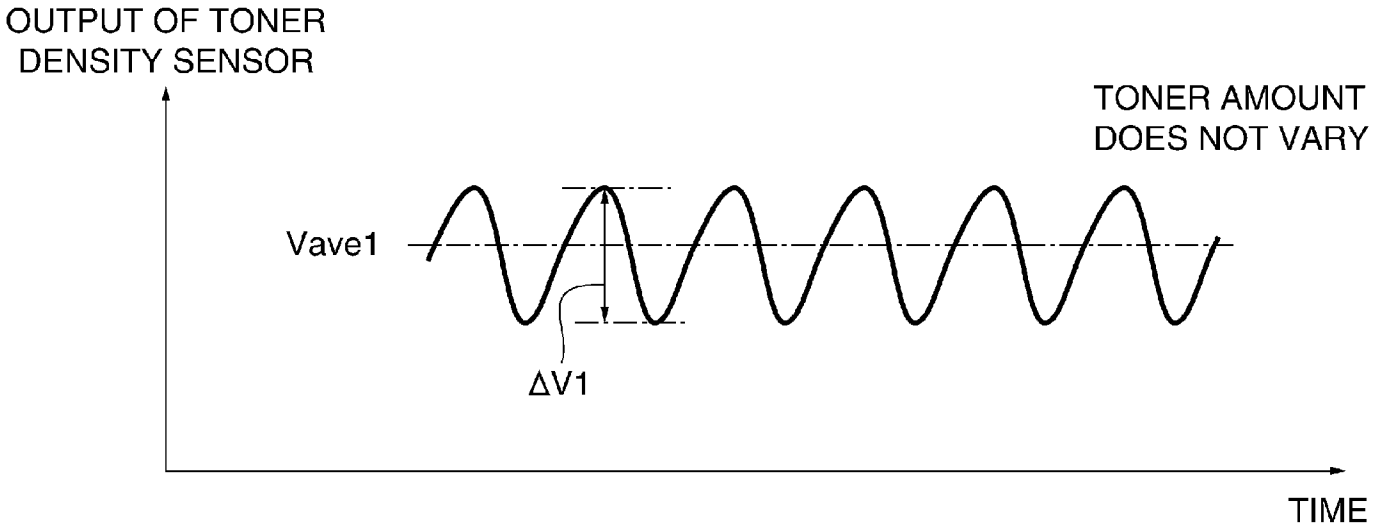
FIG. 13A and FIG. 13B are views showing output waveforms of a toner density sensor.
Figure 13B:
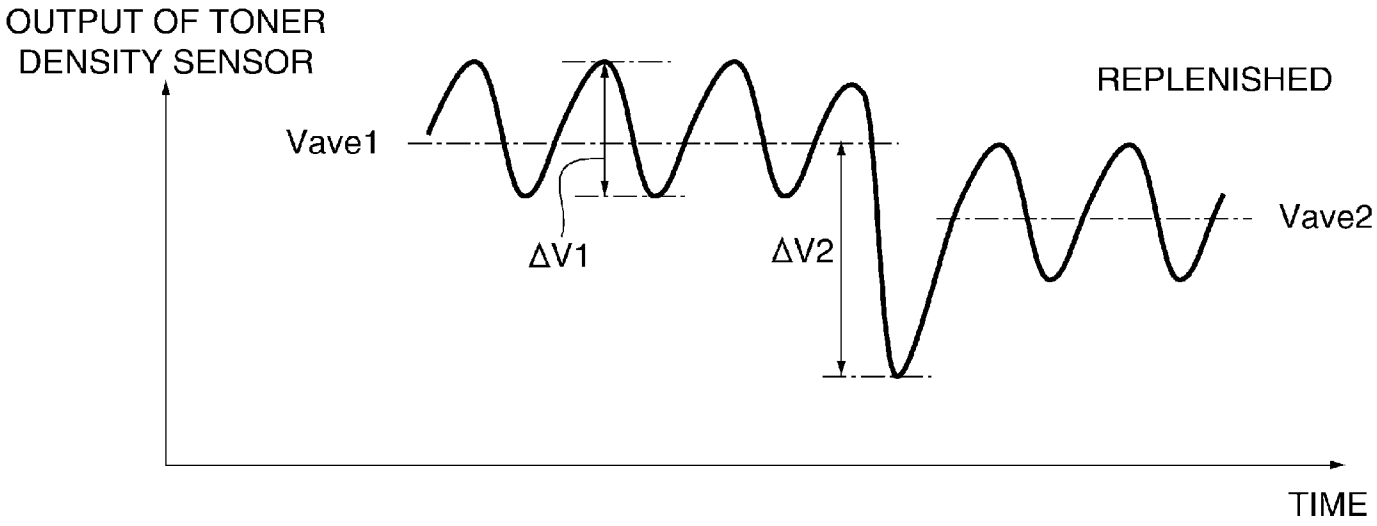

FIG. 13A and FIG. 13B are views showing output waveforms of the toner density sensor arranged in the development device. FIG. 13A shows a case where the toner amount in the development device does not vary, and FIG. 13B shows a case where the toner amount in the development device varies. In FIG. 13A and FIG. 13B, the output waveforms of the toner density sensor 25*a* vary dependent on a cycle of a stirring screw in the development device. When the toner amount in the development device does not vary because of no toner replenishment, the output waveform, When there is no toner replenishment and the toner amount in the development device does not vary, an average Vave1 of the output is constant and its amplitude ΔV1 is also constant as shown in FIG. 13A. On the other hand, when the toner is replenished to the development device, the amplitude of the output waveform varies from ΔV1 to ΔV2, and the average of the output varies from Vave1 to Vave2 as shown in FIG. 13B. It should be noted that a ratio of toner and carrier in the development device can be observed based on the variation of the output average when two-ingredient developer is used.

When the amplitude of the output waveform of the toner density sensor varies from ΔV1 to ΔV2, it is detectable that the toner is replenished to the development device 5*a* from the toner bottle 20*a*.

Figure 14:
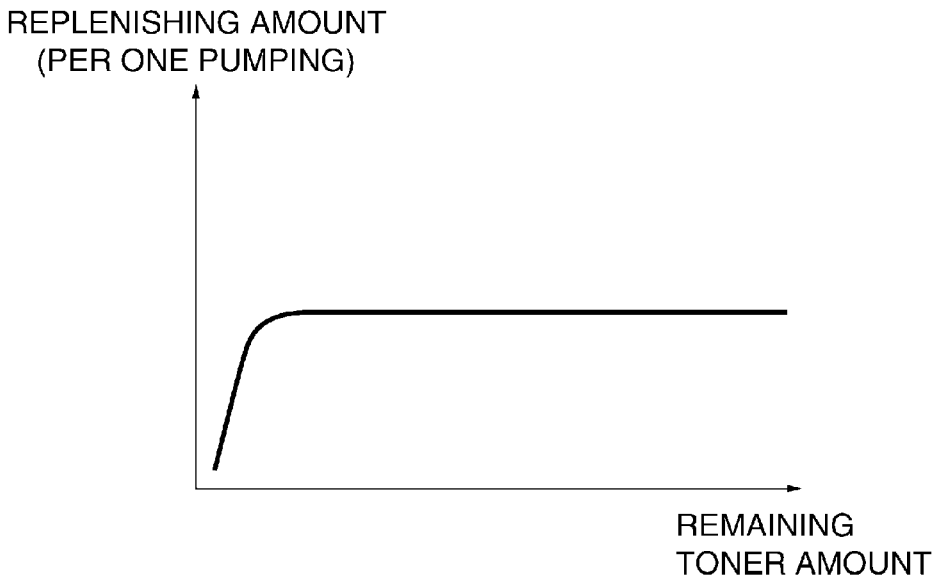
FIG. 14 is a view showing a relation between a remaining toner amount in the toner bottle and toner replenishment capability.

FIG. 14 is a view showing a relation between the remaining toner amount in the toner bottle (in a developer replenishing container) and a toner replenishment capability, and shows that the replenishment capability declines when the remaining toner amount is small.

Returning to FIG. 12, when the output of the rotation detection sensor 58 does not vary from the "Low" signal to the "Hi" signal and the mounting of the toner bottle 20*a* cannot be detected ("NO" in the step S306), the CPU 70 determines whether a predetermined time period elapsed (step S310). That is, the CPU 70 determines whether the predetermined time period elapsed after starting the rotation of the toner bottle 20*a* in the step S305. Then, when the predetermined time period does not elapse ("NO" in the step S310), the CPU 70 returns the process to the step S306 and determines again whether the output of the rotation detection sensor 58 varies from the "Low" signal to the "Hi" signal. On the other hand, when the predetermined time period elapsed ("YES" in the step S310), the CPU 70 determines that the image forming apparatus 200 is not equipped with the toner bottle 20*a*, indicates that the toner bottle is not mounted on a display panel (not shown) (step S311), and finishes this process.

The predetermined time period used in the step S310 is set so that the output of the rotation detection sensor 58 varies one or more times in the predetermined time period during the rotation of the toner bottle 20*a*. Specifically, the predetermined time period is set so as to be longer than the time period for one pumping operation.

According to the process in FIG. 12, when the remaining toner amount in the toner bottle 20*a* diminishes and the replenishment capability declines ("NO" in the step S308), the flag data is not set to 1, and the process returns to the multiple pre-rotating process (step S304). This can reduce a situation where the replenishing toner amount X that should be replenished during the image formation is superfluously corrected by the correction amount ΔX. When the remaining toner amount in the toner bottle 20*a* diminishes, the toner amount per one pumping replenished to the development device from the toner bottle 20*a* also decreases. As a result of this, the toner amount replenished to the development device 5*a* while the recovery mode is executed becomes smaller than the correction amount calculated according to the rotation information of the toner bottle 20*a*. Accordingly, when the recovery mode is executed under the state where the remaining toner amount in the toner bottle 20*a* diminishes and the flag data is set to 1, the correction amount ΔX calculated according to the rotation information is subtracted from the replenishing toner amount X even though the toner amounts replenished during the recovery mode is small. As a result, the replenishing toner amount X that should be replenished during the image formation is superfluously corrected by the correction amount ΔX. The determination in the step S308 avoids such a fault.

Moreover, according to the embodiment, when the replenishment capability does not decline ("YES" in the step S308), when the recovery mode is executed, the toner amount ΔX replenished to the development device 5*a* from the toner bottle 20*a* during the recovery mode is subtracted from the replenishing amount X of the next toner supply in the same manner as the first and second embodiments. Since the excessive replenishment of the toner to the development device 5*a* is prevented by such a process, an image density is stabilized and influence resulting from the excessive replenishment of the toner to the development device 5*a*, for example, an image defect, toner clogging, etc. can be prevented. Moreover, a possibility of giving a damage to the apparatus body can also be reduced.

Moreover, according to the embodiment, when the variation of the output of the toner density sensor 25*a* is monitored, it is detected that the toner bottle 20*a* mounted is not new, the remaining toner amount is small, and the replenishment capability declines, for example. In this case, when the replenishing amount is corrected as needed, both of the shortage of replenishment and the excessive replenishment are prevented.

Moreover, according to the embodiment, when two-ingredient developer that is mixture of toner and carrier is used as the toner contained in the toner bottle 20*a*, the excessive replenishment of not only the toner but also the carrier to the development device 5*a* is prevented.

Moreover, a measurement unit may be mounted on the toner bottle 20*a* to measure the toner replenishing amount. Furthermore, when a specified mark is formed on the toner bottle 20*a*, the rotation detection sensor 58 may detect the rotation information of the toner bottle based on the reading count of the mark concerned.

Next, a fourth embodiment will be described with reference to FIG. 15. An image forming apparatus in the fourth embodiment has a similar configuration to the image forming apparatus 200 in the first embodiment.

FIG. 15 is a flowchart showing an image forming process (a fourth image forming process) according to the fourth embodiment. The fourth image forming process is executed by the CPU 70 or the ASIC 72 arranged on the control base 300 of the image forming apparatus 200 according to a fourth image forming process program stored in a ROM (not shown).

The fourth image forming process is different from the third image forming process in that the mounting of the toner bottle 20*a* is checked just after a timing at which the electric power is supplied to the image forming apparatus 200. The other processes are the same as that in the third image forming process in FIG. 12. Thus, steps S403-S420 of FIG. 15 correspond to steps S304-S321, respectively, of FIG. 12. Accordingly, descriptions about the subsequent processes are omitted.

According to process in FIG. 15, since it is checked whether the toner bottle 20*a* is mounted just after the timing at which the electric power is supplied (S401) to the image forming apparatus 200 (the step S402), there is an effect that the recovery mode is executed promptly, in addition to the effect of the third image forming process.

Moreover, according to the embodiment, when the replenishment capability does not decline ("YES" in the step S407), when the recovery mode is executed, the toner amount ΔX replenished to the development device 5*a* from the toner bottle 20*a* during the recovery mode is subtracted from the replenishing amount X of the next toner supply in the same manner as the first and second embodiments. This prevents the excessive replenishment of the toner to the device 5*a*.

OTHER EMBODIMENTS

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-184640, filed Sep. 6, 2013, which is hereby incorporated by reference herein in its entirety.

What is claimed is:

1. An image forming apparatus comprising:

a photosensitive member;

an exposure unit configured to expose the photosensitive member to form an electrostatic latent image on the photosensitive member;

a development unit configured to form an image corresponding to image data by developing the electrostatic latent image formed on the photosensitive member;

a mounting portion to which a container is mountable, the container configured to contain toner;

a drive unit configured to rotate the container mounted to the mounting portion for replenishing the toner in the container to the development unit;

an output unit configured to output a predetermined signal when a predetermined portion of the container mounted to the mounting portion is detected, the predetermined portion being arranged in the rotation direction of the container that is rotated by the drive unit;

a determination unit configured to determine whether the container is mounted to the mounting portion according to whether the predetermined signal is outputted from the output unit;

a decision unit configured to decide a toner replenishing amount that should be replenished to the development unit;

a controller configured to control the drive unit so as to execute a detecting operation that rotates the container in a case where the determination unit does not determine that the container is mounted to the mounting portion; and a correction unit configured to correct the toner replenishing amount based on the predetermined signal output by the output unit while the detecting operation is executed.

2. The image forming apparatus according to claim 1, further comprising:

a power source configured to start the image forming apparatus, wherein the determination unit determines whether the container is mounted to the mounting portion after the power source supplies electric power.

3. The image forming apparatus according to claim 1, wherein a rotational velocity of the container when the drive unit rotates the container in order to determine whether the container is mounted to the mounting portion is a second velocity that is slower than a first velocity that is a rotational velocity of the container during a regular toner replenishment when an exchange of the container is unnecessary.

4. The image forming apparatus according to claim 1, further comprising:

a control unit configured to control the determination unit and the correction unit; and a density detection unit configured to detect toner density in the development unit, wherein the control unit checks whether the toner has replenished towards the development unit from the container when the drive unit rotates the container in order to determine whether the container is mounted to the mounting portion, based on the detection value of the density detection unit.

5. The image forming apparatus according to claim 1, wherein the correction unit does not correct the toner replenishing amount decided by the decision unit when the toner has not replenished from the container to the development unit even though the drive unit rotates the container to determine whether the container is mounted to the mounting portion.

6. The image forming apparatus according to claim 1, wherein the correction unit does not correct the replenishing amount decided by the decision unit, when the remaining toner amount in the container diminishes and toner replenishment capability declines.

7. The image forming apparatus according to claim 1, wherein the container intermittently replenishes the toner to the development unit during one rotation, and the output unit outputs rotation information that varies from a signal other than the predetermined signal to the predetermined signal when the replenishment of the toner is completed.

8. The image forming apparatus according to claim 7, wherein the correction unit quantifies the toner amount replenished to the development unit from the container based on a count of the rotation information outputted by the output unit.

9. The image forming apparatus according to claim 1, wherein the container is detachable to the mounting portion, and includes:

a chamber that contains the toner, a discharging section that discharges the toner toward the development unit, a conveying ridge that conveys the toner in the chamber toward the discharging section, a driving force receiving section into which rotational driving force is inputted from the drive unit, a driving force converting mechanism that converts the rotational driving force inputted to the driving force receiving section into linear reciprocation driving force, and a pump unit that changes volume using the reciprocation driving force, wherein the toner in the chamber is replenished to the development unit through the discharging section by extension and contraction of the pump unit.

10. An image forming apparatus comprising:

a photosensitive member;

an exposure unit configured to expose the photosensitive member to form an electrostatic latent image on the photosensitive member;

a development unit configured to develop the electrostatic latent image formed on the photosensitive member with the exposure unit using toner;

a door configured to open and close when a container is mounted to the image forming apparatus;

a drive unit configured to rotate the container mounted to the image forming apparatus, the toner in the mounted container being replenished to the development unit when the drive unit rotates the mounted container;

a detection unit configured to detect a predetermined portion arranged in a rotation direction of the mounted container when the container is mounted to the image forming apparatus, the rotation direction being a direction in which the container is rotated by the drive unit;

an execution unit configured to execute a detecting operation that rotates the mounted container so that the detection unit detects the predetermined portion, when the detection unit does not detect the predetermined portion when the door varies from an open state to a closed state;

a measurement unit configured to measure toner density in the development unit;

a decision unit configured to decide a toner replenishing amount that should be replenished to the development unit based on the measurement result of the measurement unit;

a reduction unit configured to reduce the toner replenishing amount decided by the decision unit when the detection unit detects the predetermined portion while the detecting operation is executed; and a controller configured to control the drive unit based on the replenishing amount that is reduced by the reduction unit when the detecting operation is executed, and to control the drive unit based on the replenishing amount that is decided by the decision unit when the detecting operation is not executed.

* * * * *